US005853969A

United States Patent [19]

Harada et al.

[11] Patent Number: 5,853,969

[45] Date of Patent: Dec. 29, 1998

[54] SILVER HALIDE PHOTOGRAPHIC MATERIAL CONTAINING INFRARED ABSORBING COLORANT

[75] Inventors: Toru Harada; Keiichi Suzuki; Shigeru Ohno; Koji Wariishi; Yoshiharu Yabuki, all of Kanagawa, Japan

[73] Assignee: Fuji Photo Film Co., Ltd., Kanagawa, Japan

[21] Appl. No.: 980,304

[22] Filed: Nov. 28, 1997

Related U.S. Application Data

[62] Division of Ser. No. 532,880, Sep. 22, 1995, Pat. No. 5,714,307.

[30] Foreign Application Priority Data

Sep. 22, 1994 [JP] Japan ..... 6-227983

[51] Int. Cl.[6] ..... G03C 1/815; G03C 1/825

[52] U.S. Cl. ..... 430/510; 430/517; 430/522; 430/581; 430/583; 430/584; 430/585; 430/944; 430/966

[58] Field of Search ..... 430/510, 517, 430/522, 581, 583, 584, 585, 944, 966

[56] References Cited

U.S. PATENT DOCUMENTS

| | | | |
|---|---|---|---|
| 4,801,525 | 1/1989 | Mihara et al. | 430/578 |
| 4,837,140 | 6/1989 | Ikeda et al. | 430/550 |
| 4,988,611 | 1/1991 | Anderson et al. | 430/494 |
| 5,063,146 | 11/1991 | Inagaki et al. | 430/944 |
| 5,547,819 | 8/1996 | Ohno et al. | 430/522 |

FOREIGN PATENT DOCUMENTS

| | | |
|---|---|---|
| A0342576 | 11/1989 | European Pat. Off. . |
| A0479167 | 4/1992 | European Pat. Off. . |
| A0556845 | 8/1993 | European Pat. Off. . |
| A0577138 | 1/1994 | European Pat. Off. . |
| A387519 | 2/1933 | United Kingdom . |

*Primary Examiner*—Geraldine Letscher
*Attorney, Agent, or Firm*—Sughrue, Mion, Zinn, Macpeak & Seas, PLLC

[57] ABSTRACT

A silver halide photographic material comprises a support, at least one silver halide emulsion layer and at least one non-light-sensitive hydrophilic colloidal layer. The silver halide emulsion layer or the hydrophilic colloidal layer contains a colorant having the absorption maximum wavelength within the infrared region of 700 to 1,100 nm. The colorant is in the form of solid particles dispersed in the silver halide emulsion layer or in the hydrophilic colloidal layer. The solid particles cannot substantially be removed by a processing solution of the silver halide photographic material. An image forming process employing the silver halide photographic material is also disclosed.

9 Claims, No Drawings

SILVER HALIDE PHOTOGRAPHIC MATERIAL CONTAINING INFRARED ABSORBING COLORANT

This is a divisional of application Ser. No. 08/532,880 filed Sep. 22, 1995, now U.S. Pat. No. 5,714,307.

FIELD OF THE INVENTION

The present invention relates to a silver halide photographic material comprising a support, at least one silver halide emulsion layer and at least one non-light-sensitive hydrophilic colloidal layer. The invention particularly relates to a silver halide photographic material containing an infrared absorbing colorant.

BACKGROUND OF THE INVENTION

A silver halide photographic material has recently been automatically treated in a developing machine. The automatic developing machine usually has a detecting mechanism, which detects an inserted photographic material and sends a signal for the machine to start the developing treatment. An exposing device for a photographic material often has a similar detecting mechanism. The detecting mechanism usually is an optical sensor, which comprises a light source and a photoelectric element. The mechanism detects a photographic material inserted between the light source and the photoelectric element. In more detail, the mechanism detects whether light between the light source and the element is shielded or not. The light should have a wavelength outside a spectrally sensitized region of silver halide. Accordingly, the light usually has a wavelength within the infrared region of 700 to 1,100 nm. The detecting mechanism has been constructed provided that a silver halide photographic material has a sufficient absorption within the infrared region. The conventional photographic materials usually have the sufficient absorption.

By the way, a rapid development process has recently been required. The above-described automatic developing machine has been used for the rapid development. A recent photography also requires decreasing the amount of a replenisher (a replenishing solution). The rapid development and the decrease of the replenisher are particularly required for a medical X-ray black and white photographic material. It is most effective in shortening the developing time and decreasing the replenisher to reduce the amount of silver halide contained in the photographic material. A photographic material has been greatly improved. For example, the sensitivity of silver halide has been increased to obtain a sufficient sensitivity of the photographic material even though the amount of silver halide is reduced. As a result, a recent photographic material, particularly a X-ray black and white photographic material contains a very small amount of silver halide (amount in terms of coated silver: less than 4 g per $m^2$).

A photographic material having a silver amount of not less than 4 g per $m^2$ does not have a sufficient light absorption for the above-described detecting mechanism. Therefore, it is difficult for the detecting mechanism to detect a recent photographic material containing a small amount of silver halide.

An infrared absorbing colorant (dye or pigment) can be added to a silver halide photographic material to solve the above-mentioned problem. However, the infrared absorbing colorant usually has an absorption within a visible region (usually a red region). If the colorant remains in the photographic material after image formation, the obtained image would be unclear. Therefore, the colorant should be removed from the photographic material by a processing solution.

Japanese Patent Provisional Publication No. 62(1987)-299959 discloses an X ray photographic material having a silver amount of not less than 4 g per $m^2$. The photographic material comprises an emulsion layer on one side of a support and a layer arranged on the opposite side of the support containing an infrared absorbing colorant. The publication describes that the infrared absorbing colorant can be added to the photographic material according to various methods. For example, a water-soluble dye can be directly added to a coating solution of the layer. A colorant can also be dispersed in the layer using a high boiling organic solvent, which is analogous to a known dispersing method of a coupler. Further, a colorant can be adsorbed on metal salt grains such as silver halide grains dispersed in the layer. Furthermore, a colorant can be dispersed in the layer according to a latex dispersing method. The publication further describes that the infrared absorbing colorant is preferably bleached or detached at a development process to make the photographic material substantially colorless. In Example 1 of the publication, an infrared absorbing colorant is adsorbed on silver halide grains. The colorant has a strong absorption within the visible region. Therefore, the colorant must be detached from the silver halide grains at the development process and removed from the photographic material by a processing solution.

Japanese Patent Provisional Publication No. 1(1989)-266536 discloses an infrared sensitive silver halide photographic material. The photographic material contains an infrared absorbing colorant in a non-light-sensitive layer. The publication describes that the colorant is preferably adsorbed on inorganic salt grains in the layer that can be dissolved in a processing solution. Further, the amount of the colorant is determined provided that the colorant is removed from the photographic material by the processing solution. In each Examples of the publication, the infrared absorbing colorant is dissolved in the processing solution to remove the colorant from the photographic material.

Japanese Patent Provisional Publication No. 3(1992)-266536 discloses a silver halide photographic material containing a colorant having a light absorption maximum wavelength in the range of 700 to 1,700 nm, which is measured using a solution of the colorant. The colorant is in the form of solid particles dispersed in a hydrophilic colloidal layer. The publication describes that the colorant is preferably dissolved in a processing solution or bleached by a chemical reaction. In each Examples of the publication, the infrared absorbing colorant is also dissolved in the processing solution to remove the dye from the photographic material.

SUMMARY OF THE INVENTION

The problem of the infrared ray detecting mechanism has been solved by adding an infrared absorbing colorant and removing the colorant by a processing solution according to the above-described prior art. However, the applicants note another problem caused by the prior art.

As is described above, the problem of the infrared ray detecting mechanism was caused by the decrease of the amount of the replenisher. If the colorant is removed by the processing solution, the function of the solution is extended. It is difficult to decrease the amount of the developing solution where the colorant is sufficiently removed by the solution. Therefore, a certain amount of the solution must be replenished to remove the colorant from the photographic material.

An object of the present invention is to solve the problem of the infrared ray detecting mechanism without increasing the amount of the replenisher.

The present invention provides a silver halide photographic material comprising a support, at least one silver halide emulsion layer and at least one non-light-sensitive hydrophilic colloidal layer, said silver halide emulsion layer or said hydrophilic colloidal layer containing a colorant having the absorption maximum wavelength within the infrared region of 700 to 1,100 nm, and said colorant being in the form of solid particles dispersed in the silver halide emulsion layer or in the hydrophilic colloidal layer, wherein the solid particles cannot substantially be removed by a processing solution of the silver halide photographic material.

The invention also provides an image forming process comprising the steps of:

imagewise exposing to light a silver halide photographic material comprising a support, at least one silver halide emulsion layer and at least one non-light-sensitive hydrophilic colloidal layer, said silver halide emulsion layer or said hydrophilic colloidal layer containing a colorant having the absorption maximum wavelength within the infrared region of 700 to 1,100 nm, and said colorant being in the form of solid particles dispersed in the silver halide emulsion layer or in the hydrophilic colloidal layer;

inserting the exposed photographic material into an automatic developing machine having an infrared ray detecting mechanism, whereby the mechanism detects the inserted photographic material to send a signal to the developing machine; and then working the developing machine whereby the photographic material is developed with a processing solution, wherein the solid particles are substantially not removed from the photographic material by the processing solution.

The applicants have studied the colorant having the absorption maximum wavelength within the infrared region of 700 to 1,100 nm (which is sometimes referred to as infrared absorbing colorant). As a result, the applicants note that the absorption maximum wavelength of the colorant in the form of solid particles is considerably longer than that of the same colorant in the form of a solution. The difference in the wavelength is usually larger than 50 nm. In the form of the solid particles, the absorption within the visible region is remarkably reduced with the change of the absorption maximum wavelength.

Accordingly, it is not necessary to remove the infrared absorbing colorant in the form of solid particles from the photographic material. Therefore, the colorant may be in the form of solid particles that cannot substantially be removed by a processing solution of the silver halide photographic material.

The infrared absorbing colorant used in the present invention should not be removed by the processing solution. Accordingly, the amount of the replenisher can be reduced according to the invention because the processing solution does not have an additional removing function. Therefore, the present invention now solves the problem of the infrared ray detecting mechanism without increasing the amount of the replenisher.

DETAILED DESCRIPTION OF THE INVENTION

The silver halide photographic material of the present invention is characterized in that the solid particles of an infrared absorbing colorant are substantially not removed from the photographic material by the processing solution.

The infrared absorbing colorant has an absorption maximum wavelength within the infrared region of 700 to 1,100 nm. The region is preferably in the range of 800 to 1,000 nm, and more preferably in the range of 850 to 950 nm. The value of the absorption maximum wavelength is measured in the silver halide photographic material (not in the form of a solution) using a spectrophotometer.

The infrared absorbing colorant is in the form of solid particles. The solid particles are substantially not removed from the photographic material by the processing solution. In the embodiment of the photographic material of the present invention, the term "substantially not removed" means that the remaining ratio of the absorption at the maximum wavelength is not less than 90% after the photographic material is immersed for 45 seconds in a BR (Briton-Robinson) buffer at 35° C. and at pH 10.0. In the embodiment of the image forming process, the term "substantially not removed" means that the remaining ratio of the absorption at the maximum wavelength is not less than 90% after the image is formed. The remaining ratio preferably is not less than 93%, more preferably is not less than 95%, and most preferably is not less than 97%. To increase the remaining ratio, a colorant itself preferably is insoluble in the processing solution, particularly in a developing solution. The solubility of the dye in the solution can be determined by using the above-mentioned BR buffer in place of the processing solution.

A dye or pigment having the above-mentioned definitions can be used as the infrared absorbing colorant of the present invention. A dye is usually preferred to a pigment. A water-soluble dye (which is easily dissolved in a processing solution) can also be used in the invention by subjecting the dye to a water-insoluble treatment such as a lake formation.

The solid particles have an average particle size preferably in the range of 0.005 to 10 μm, more preferably in the range of 0.01 to 1 μm, and most preferably in the range of 0.01 to 0.11 μm.

The content of the colorant in the particle preferably is not less than 80 wt.%, more preferably is not less than 90 wt. %, and most preferably is 100 wt. %.

The colorant is contained in the silver halide emulsion layer or the hydrophilic colloidal layer preferably in an amount of 0.001 to 1 g per $m^2$, and more preferably in an amount of 0.005 to 0.5 g per $m^2$.

A preferred infrared colorant is a cyanine dye represented by the formula (I):

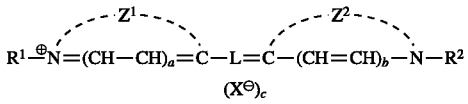

(I)

In the formula (I), each of $Z^1$ and $Z^2$ independently is a non-metallic atomic group that forms a five-membered or six-membered nitrogen-containing heterocyclic ring. The ring may be condensed with another ring. Examples of the heterocyclic rings and the condensed rings include oxazole ring, isooxazole ring, benzoxazole ring, naphthoxazole ring, thiazole ring, benzthiazole ring, naphthothiazole ring, indolenine ring, benzindolenine ring, imidazole ring, benzimidazole ring, naphthimidazole ring, quinoline ring, pyridine ring, pyrrolopyridine ring, furopyrrole ring, indolizine ring, imidazoquinoxaline ring and quinoxaline ring. The nitrogen-containing heterocyclic ring preferably is a five-membered ring. The five-membered heterocyclic ring is preferably condensed with benzene ring or naphthalene ring. Indolenine ring and benzindolenine ring are particularly preferred.

The heterocyclic ring and the condensed ring may have a substituent group. Examples of the substituent groups include an alkyl group having 10 or less (preferably 6 or less) carbon atoms (e.g., methyl, ethyl, propyl, butyl, isobutyl, pentyl, hexyl), an alkoxy group having 10 or less (preferably 6 or less) carbon atoms (e.g., methoxy, ethoxy), an aryloxy group having 20 or less (preferably 12 or less) carbon atoms (e.g., phenoxy, p-chlorophenoxy), a halogen atom (Cl, Br, F), an alkoxycarbonyl group having 10 or less (preferably 6 or less) carbon atoms (e.g., ethoxycarbonyl), cyano, nitro and carboxyl. Carboxyl may form a salt with a cation. Further, carboxyl may form an intramolecular salt with $N^+$ in the formula (I). Preferred substituent groups include chloride (Cl), methoxy, methyl and carboxyl.

In the case that the heterocyclic ring is substituted with carboxyl, the absorption maximum wavelength is greatly increased where the dye is in the form of solid particles. However, a compound having carboxyl might be dissolved in a processing solution because carboxyl is a hydrophilic group. In such a case, a lake formation is effectively used to decrease the solubility of the compound in the processing solution. Further, an alkyl group having 3 or more carbon atoms or an aryl group may be attached to $R^1$, $R^2$ or L in the formula (I) to decrease the solubility.

On the other hand, a compound having no carboxyl group is preferably dispersed for a long term to form the solid particles. The maximum absorption of the compound is shifted to a long wave region by dispersing the compound for a long term. Further, the below-described formula (Ic) is particularly preferred in the case that the compound has no carboxyl group.

In the formula (I), each of $R^1$ and $R^2$ independently is an alkyl group, an alkenyl group or an aralkyl group. An alkyl group is preferred. An alkyl group having no substituent group is particularly preferred.

The alkyl group preferably has 1 to 10 carbon atoms, and more preferably has 1 to 6 carbon atoms. Examples of the alkyl groups include methyl, ethyl, propyl, butyl, isobutyl, pentyl and hexyl. The alkyl group may have a substituent group. Examples of the substituent groups include a halogen atom (Cl, Br, F), an alkoxycarbonyl group having 10 or less (preferably 6 or less) carbon atoms (e.g., methoxycarbonyl, ethoxycarbonyl) and hydroxyl.

The alkenyl group preferably has 2 to 10 carbon atoms, and more preferably has 2 to 6 carbon atoms. Examples of the alkenyl groups include 2-pentenyl, vinyl, allyl, 2-butenyl and 1-propenyl. The alkenyl group may have a substituent group. Examples of the substituent groups include a halogen atom (Cl, Br, F), an alkoxycarbonyl group having 10 or less (preferably 6 or less) carbon atoms (e.g., methoxycarbonyl, ethoxycarbonyl) and hydroxyl.

The aralkyl group preferably has 7 to 12 carbon atoms. Examples of the aralkyl groups include benzyl and phenethyl. The aralkyl group may have a substituent group. Examples of the substituent groups include a halogen atom (Cl, Br, F), an alkyl group having 10 or less (preferably 6 or less) carbon atoms (e.g., methyl) and an alkoxy group having 10 or less (preferably 6 or less) carbon atoms (e.g., methoxy).

In the formula (I), L is a linking group having conjugated double bonds formed by a combination of five, seven or nine methine groups. The number of the methine groups preferably is seven (heptamethine compound) or nine (nonamethine compound), and more preferably is seven.

The methine groups may have a substituent group. The substituent group is preferably attached to the central (meso) methine group. The substituent groups are described below referring to the formula L5 (pentamethine), L7 (heptamethine) and L9 (nonamethine).

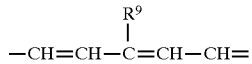

(L5)

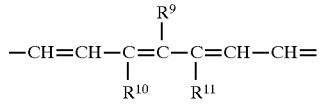

(L7)

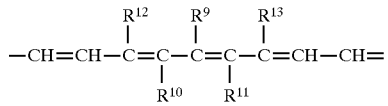

(L9)

wherein $R^9$ is hydrogen, an alkyl group, a halogen atom, an aryl group, $-NR^{14}R^{15}$ (wherein $R^{14}$ is an alkyl group or an aryl group, $R^{15}$ is hydrogen, an alkyl group, an aryl group, an alkylsulfonyl group, an arylsulfonyl group or an acyl group, or $R^{14}$ and $R^{15}$ are combined with each other to form a nitrogen-containing heterocyclic ring), an alkylthio group, an arylthio group, an alkoxy group or an aryloxy group; each of $R^{10}$ and $R^{11}$ is hydrogen, or $R^{10}$ and $R^{11}$ are combined with each other to form a five-membered or six-membered ring; and each of $R^{12}$ and $R^{13}$ independently is hydrogen or an alkyl group.

$R^9$ preferably is $-NR^{14}R^{15}$. At least one of $R^{14}$ and $R^{15}$ preferably is phenyl.

$R^{10}$ and $R^{11}$ are preferably combined with each other to form a five-membered or six-membered ring. In the case that $R^9$ is hydrogen, $R^{10}$ and $R^{11}$ more preferably form the ring. Examples of the rings include cyclopentene ring and cyclohexene ring. The ring may have a substituent group (in addition to $R^9$). Examples of the substituent groups include an alkyl group and an aryl group.

The above-mentioned alkyl group preferably has 1 to 10 carbon atoms, and more preferably has 1 to 6 carbon atoms. Examples of the alkyl groups include methyl, ethyl, propyl, butyl, isobutyl, pentyl and hexyl. The alkyl group may have a substituent group. Examples of the substituent groups include a halogen atom (Cl, Br, F), an alkoxycarbonyl group having 10 or less (preferably 6 or less) carbon atoms (e.g., methoxycarbonyl, ethoxycarbonyl) and hydroxyl.

Examples of the above-mentioned halogen atoms include fluorine, chlorine and bromine.

The above-mentioned aryl group preferably has 6 to 12 carbon atoms. Examples of the aryl groups include phenyl and naphthyl. The aryl group may have a substituent group. Examples of the substituent groups include an alkyl group having 10 or less (preferably 6 or less) carbon atoms (e.g., methyl, ethyl, propyl, butyl, isobutyl, pentyl, hexyl), an aryloxy group having 20 or less (preferably 12 or less) carbon atoms (e.g., phenoxy, p-chlorophenoxy), a halogen atom (Cl, Br, F), an alkoxycarbonyl group having 10 or less (preferably 6 or less) carbon atoms (e.g., ethoxycarbonyl), cyano, nitro and carboxyl.

The above-mentioned alkylsulfonyl group preferably has 1 to 10 carbon atoms. Examples of the alkylsulfonyl groups include mesyl and ethanesulfonyl.

The above-mentioned arylsulfonyl group preferably has 6 to 10 carbon atoms. Examples of the arylsulfonyl groups include tosyl and benzoyl.

The above-mentioned acyl group preferably has 2 to 10 carbon atoms. Examples of the acyl groups include acetyl, propionyl and benzoyl.

Examples of the nitrogen-containing heterocyclic rings formed by $R^{14}$ and $R^{15}$ include piperidine ring, morpholine ring and piperazine ring. The heterocyclic ring may have a substituent group. Examples of the substituent groups include an alkyl group (e.g., methyl), an aryl group (e.g., phenyl) and an alkoxycarbonyl group (e.g., ethoxycarbonyl).

In the formula (I), each of a, b and c independently is 0 or 1. Each of a and b preferably is 0. On the other hand, c usually is 1. However, c may be 0 in the case that an anionic substituent group such as carboxyl forms an intramolecular salt with $N^+$ in the formula (I).

In the formula (I), X is an anion. Examples of the anions include halide ions (e.g., $Cl^-$, $Br^-$, $I^-$), p-toluenesulfonate ion, ethylsulfate ion, $PF_6^-$, $BF_4^-$ and $ClO_4^-$.

A more preferred heptamethine cyanine dye is represented by the formula (Ib):

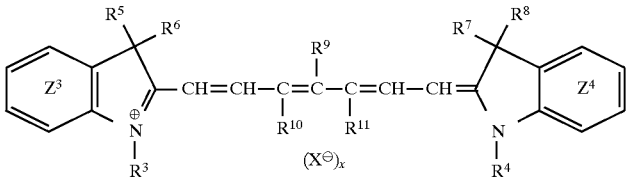

(Ib)

wherein each of the benzene rings of $Z^3$ and $Z^4$ may be condensed with another benzene ring; each of $R^3$ and $R^4$ independently is an alkyl group, an alkenyl group or an aralkyl group; each of $R^5$, $R^6$, $R^7$ and $R^8$ independently is an alkyl group, or $R^5$ and $R^6$ or $R^7$ and $R^8$ are combined with each other to form a ring; $R^9$ is hydrogen, an alkyl group, a halogen atom, an aryl group, $-NR^{14}R^{15}$ (wherein $R^{14}$ is an alkyl group or an aryl group, $R^{15}$ is hydrogen, an alkyl group, an aryl group, an alkylsulfonyl group, an arylsulfonyl group or an acyl group, or $R^{14}$ and $R^{15}$ are combined with each other to form a nitrogen-containing heterocyclic ring), an alkylthio group, an arylthio group, an alkoxy group or an aryloxy group; each of $R^{10}$ and $R^{11}$ is hydrogen, or $R^{10}$ and $R^{11}$ are combined with each other to form a five-membered or six-membered ring; X is an anion; and c is 0 or 1.

In the formula (Ib), the benzene rings of $Z^3$ and $Z^4$ and another condensed benzene ring may have a substituent group. Examples of the substituent groups are the same as those of the substituent groups of $Z^1$ and $Z^2$ in the formula (I).

In the formula (Ib), $R^3$ and $R^4$ have the same meanings as $R^1$ and $R^2$ in the formula (I).

The alkyl group of $R^5$, $R^6$, $R^7$ and $R^8$ have the same meanings as the alkyl group of $R^1$ and $R^2$ in the formula (I). An example of the ring formed by $R^5$ and $R^6$ or $R^7$ and $R^8$ is cyclohexane ring.

In the formula (Ib), $R^9$, $R^{10}$ and $R^{11}$ have the same meanings as $R^9$, $R^{10}$ and $R^{11}$ in the formula (L7).

In the formula (Ib), X and c have the same meanings as X and c in the formula (I).

A further preferred heptamethine cyanine dye is represented by the formula (Ic).

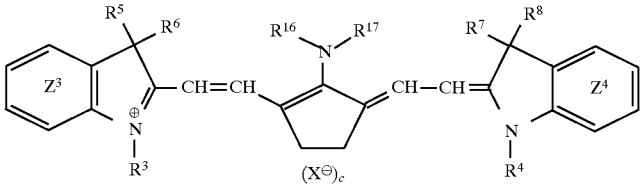

(Ic)

wherein each of the benzene rings of $Z^3$ and $Z^4$ may be condensed with another benzene ring; each of $R^3$ and $R^4$ independently is an alkyl group, an alkenyl group or an aralkyl group; each of $R^5$, $R^6$, $R^7$ and R8 independently is an alkyl group, or $R^5$ and $R^6$ or $R^7$ and $R^8$ are combined with each other to form a ring; each of $R^{16}$ and $R^{17}$ independently is an alkyl group or an aryl group; X is an anion; and c is 0 or 1.

In the formula (Ic), the benzene rings of $Z^3$ and $Z^4$ and another condensed benzene ring may have a substituent group. Examples of the substituent groups are the same as those of the substituent groups of $Z^1$ and $Z^2$ in the formula (I).

In the formula (Ic), $R^3$ and $R^4$ have the same meanings as $R^1$ and $R^2$ in the formula (I).

The alkyl group of $R^5$, $R^6$, $R^7$ and $R^8$ have the same meanings as the alkyl group of $R^1$ and $R^2$ in the formula (I). An example of the ring formed by $R^5$ and $R^6$ or $R^7$ and $R^8$ is cyclohexane ring.

The alkyl group of $R^{16}$ and $R^{17}$ have the same meanings as the alkyl group of $R^1$ and $R^2$ in the formula (I). The aryl group of $R^{16}$ and $R^{17}$ have the same meanings as the aryl group in the formulas (L5) to (L9).

In the formula (Ic), X and c have the same meanings as X and c in the formula (I).

Examples of the cyanine dyes are shown below.

(1)–(6)
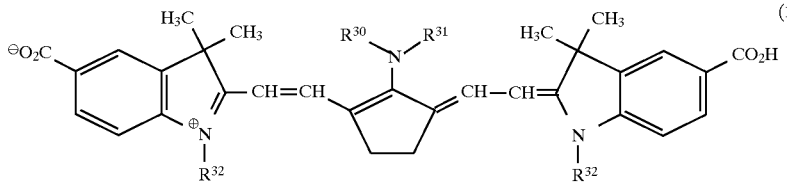
| | $R^{30}$ | $R^{31}$ | $R^{32}$ |
|---|---|---|---|
| (1) | phenyl | phenyl | $CH_3$ |
| (2) | 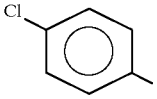 | 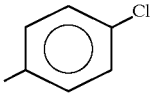 | $CH_3$ |
| (3) | phenyl | $CH_3$ | $CH_3$ |
| (4) | 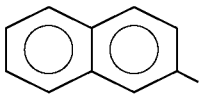 | $C_2H_5$ | $C_2H_5$ |
| (5) | $CH_3$ | phenyl | n-$C_4H_9$ |
| (6) | 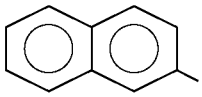 | 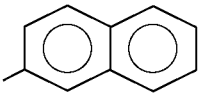 | $CH_3$ |
(7)–(11)
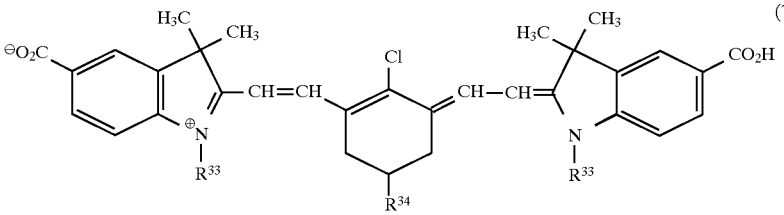
| | $R^{33}$ | $R^{34}$ |
|---|---|---|
| (7) | n-$C_4H_9$ | $CH_3$ |
| (8) | n-$C_4H_9$ | t-$C_4H_9$ |
| (9) | n-$C_4H_9$ | phenyl |
| (10) | $C_3H_7$ | phenyl |
| (11) | n-$C_6H_{13}$ | t-$C_4H_9$ |
(12)–(19)
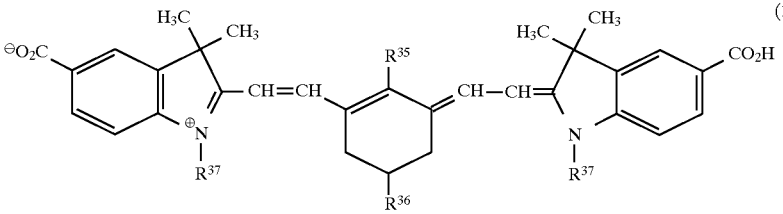
| | $R^{35}$ | $R^{36}$ | $R^{37}$ |
|---|---|---|---|
| (12) | 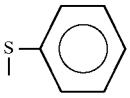 | $CH_3$ | $CH_3$ |
| (13) | 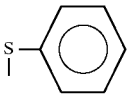 | t-$C_4H_9$ | $CH_3$ |

-continued
| | | | |
|---|---|---|---|
| (14) | 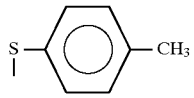 | phenyl | $CH_3$ |
| (15) | 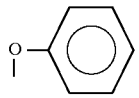 | t-$C_4H_9$ | $CH_3$ |
| (16) | 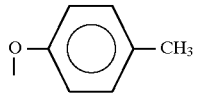 | phenyl | $CH_3$ |
| (17) | 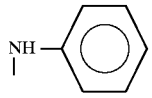 | t-$C_4H_9$ | $CH_3$ |
| (18) | 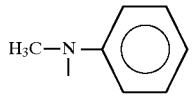 | t-$C_4H_9$ | $CH_3$ |
| (19) | phenyl | H | $C_4H_9$ |
(20)–(25)
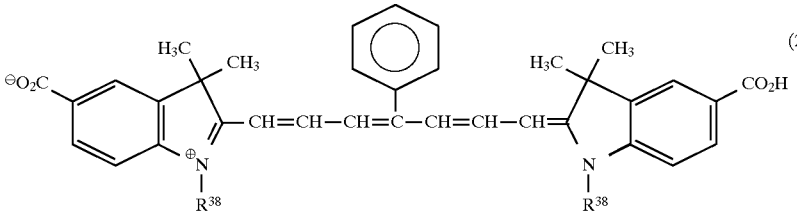
| | $R^{38}$ | | $R^{38}$ | | $R^{38}$ |
|---|---|---|---|---|---|
| (20) | $CH_3$ | (21) | $C_2H_5$ | (22) | n-$C_3H_7$ |
| (23) | n-$C_4H_9$ | (24) | n-$C_5H_{11}$ | (25) | n-$C_6H_{13}$ |
(26)–(30)
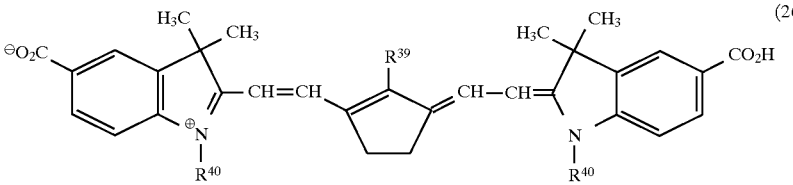
| | $R^{39}$ | $R^{40}$ |
|---|---|---|
| (26) | 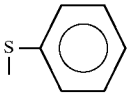 | n-$C_4H_9$ |
| (27) | 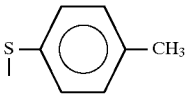 | n-$C_4H_9$ |
| (28) | 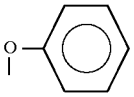 | n-$C_4H_9$ |
| (29) | 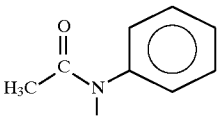 | $CH_3$ |

-continued
(30)
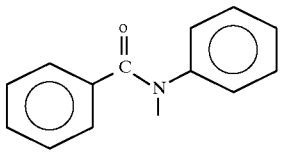
$CH_3$
(31)–(33)
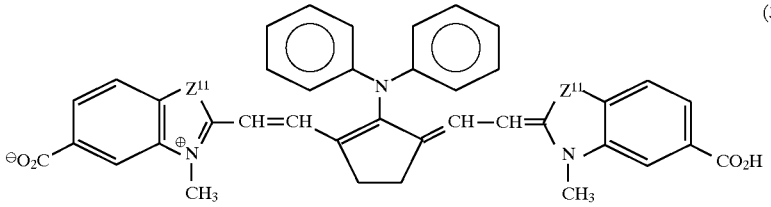
| | $Z^{11}$ | | $Z^{11}$ | | $Z^{11}$ |
|---|---|---|---|---|---|
| (31) | O | (32) | S | (33) | $N-CH_3$ |
(34)
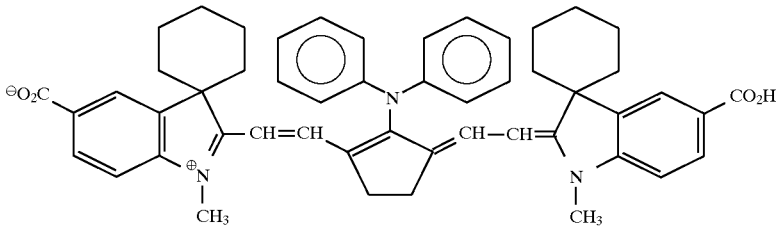
(35)–(36)
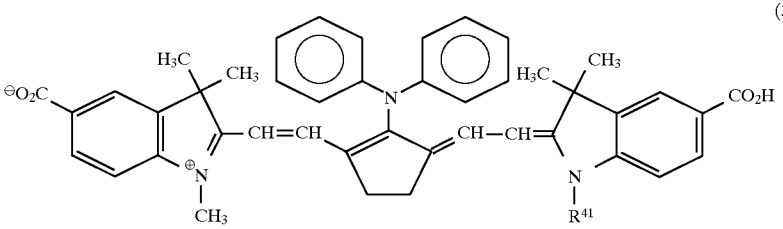
| | $R^{41}$ | | $R^{41}$ |
|---|---|---|---|
| (35) | $CH_2-CH=CH_2$ | (36) | $CH_2$ |
(37)–(38)
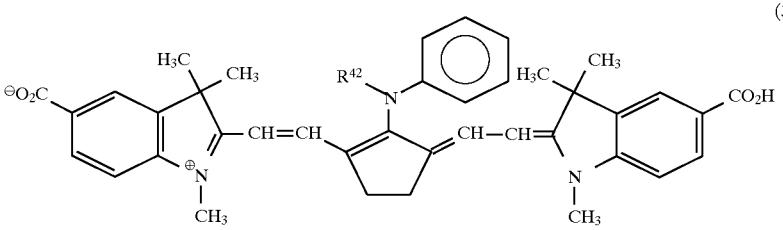
| | $R^{42}$ | | $R^{42}$ |
|---|---|---|---|
| (37) | $H_3C-SO_2$ | (38) | $SO_2$ |

-continued
(39)–(42)
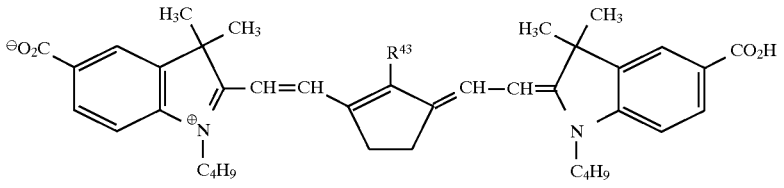
$R^{43}$ $R^{43}$
(39)
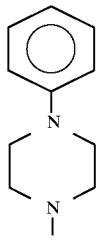
(40)
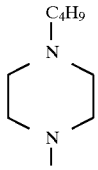
(41)
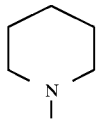
(42) Cl
(43)–(52)
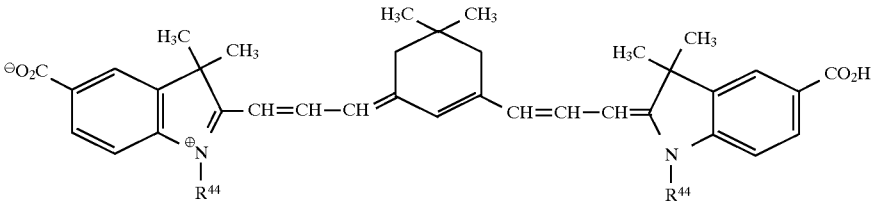
$R^{44}$ $R^{44}$
| | | | |
|---|---|---|---|
| (43) | $CH_3$ | (44) | $C_2H_5$ |
| (45) | n-$C_3H_7$ | (46) | n-$C_4H_9$ |
| (47) | $CH_2CH_2—CONH_2$ | (48) | $CH_2CH_2$ 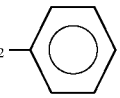 |
| (49) | $CH_2—CH=CH_2$ | (50) | $CH_2CH_2CONH$ 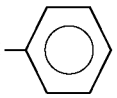 |
| (51) | $CH_2CH(CH_3)_2$ | (52) | $CH_2$ 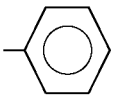 |

-continued
(53)–(55)
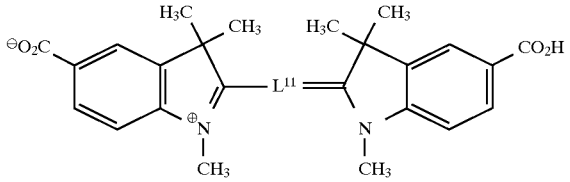
$L^{11}$
(53)
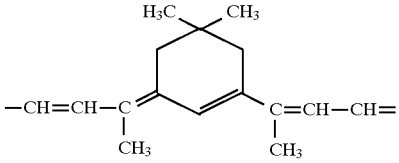
(54)
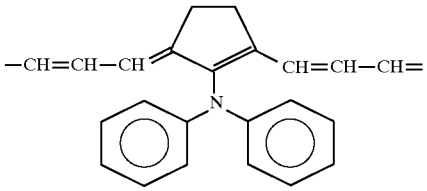
(55)
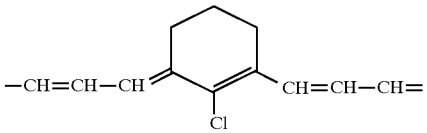
(56)–(60)
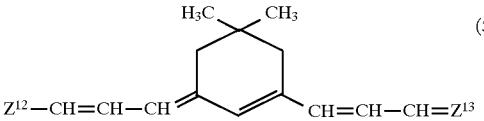
$Z^{12}$ $Z^{13}$
(56)
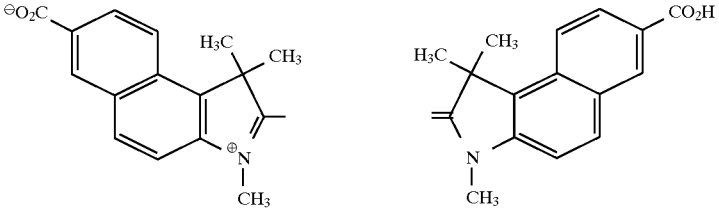
(57)
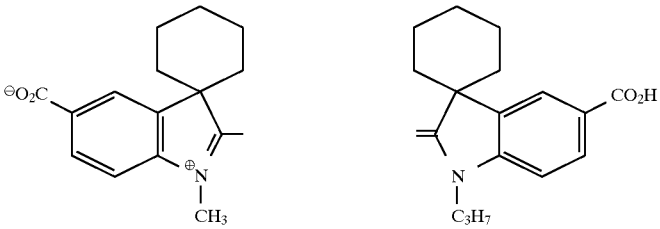
(58)
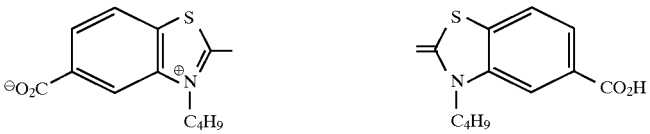

-continued
(59)
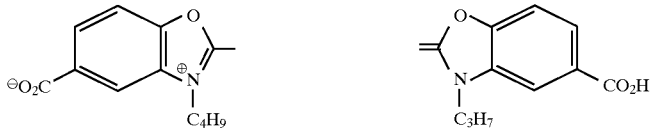
(60)
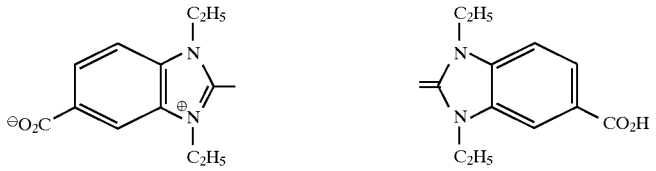
(61)
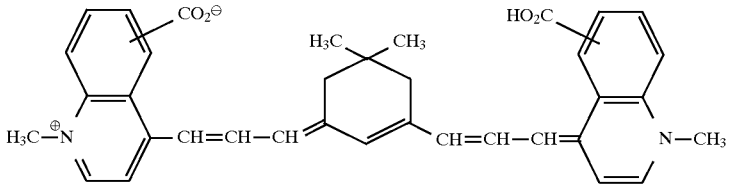
(62)–(71)
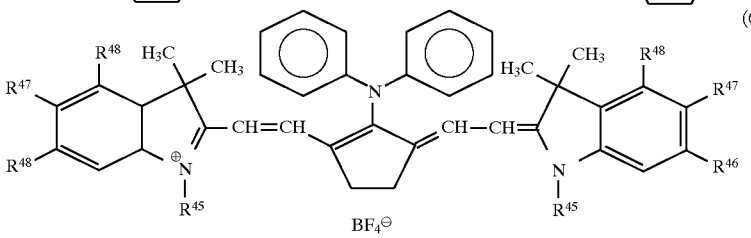
| | $R^{45}$ | $R^{46}$ | $R^{47}$ | $R^{48}$ |
|---|---|---|---|---|
| (62) | $CH_3$ | H | H | H |
| (63) | $CH_3$ | H | Cl | H |
| (64) | $CH_3$ | H | $OCH_3$ | H |
| (65) | $CH_3$ | H | CN | H |
| (66) | $CH_3$ | H | $CO_2C_2H_5$ | H |
| (67) | $CH_3$ | H | $NO_2$ | H |
| (68) | $CH_3$ | H | $CH_3$ | H |
| (69) | $CH_3$ | H | Cl | Cl |
| (70) | $CH_3$ | Cl | H | Cl |
| (71) | $C_2H_3$ | H | Cl | H |
(72)–(81)
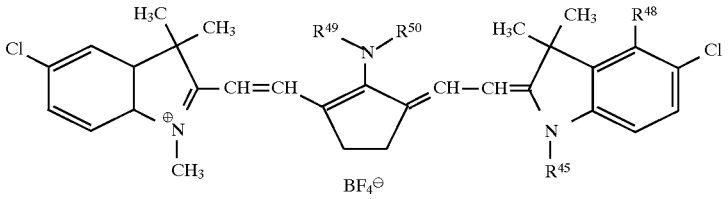
| | $R^{49}$ | $R^{50}$ |
|---|---|---|
| (72) | $CH_3$ | phenyl |
| (73) | $C_2H_5$ | phenyl |
| (74) | 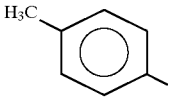 | 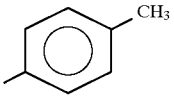 |
| (75) | 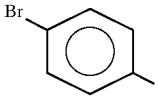 | 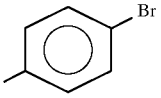 |

-continued
| | | |
|---|---|---|
| (76) | 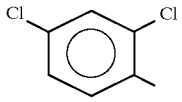 | 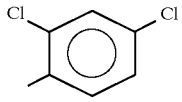 |
| (77) | 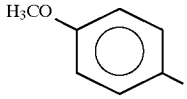 | 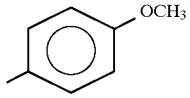 |
| (78) | 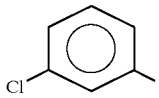 | 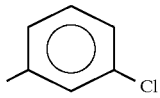 |
| (79) | $CH_3$ | $CH_3$ |
| (80) | $C_2H_5$ | $C_2H_5$ |
| (81) | 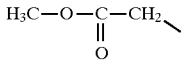 | 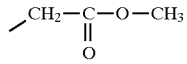 |
(82)–(89)
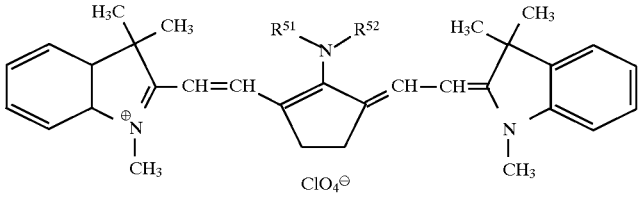
| | $R^{51}$ | $R^{52}$ |
|---|---|---|
| (82) | phenyl | 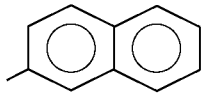 |
| (83) | phenyl | 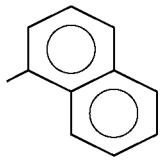 |
| (84) | 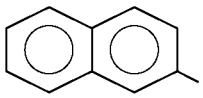 | 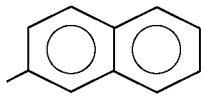 |
| (85) | $CH_3$ | 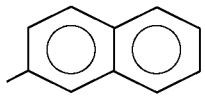 |
| (86) | $C_4H_9$ | 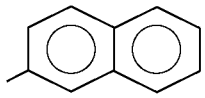 |
| (87) | phenyl | $SO_2-CH_3$ |
| (88) | phenyl | $C(=O)-CH_3$ |
| (89) | phenyl | H |

-continued
(90)–(97)
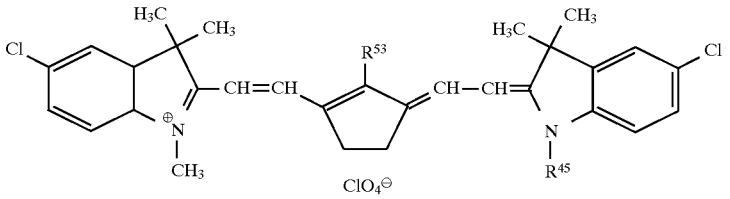
| | $R^{53}$ | | $R^{53}$ |
|---|---|---|---|
| (90) | Cl | (91) | $OCH_3$ |
| (92) | 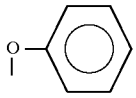 | (93) | 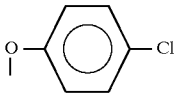 |
| (94) | 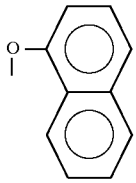 | (95) | 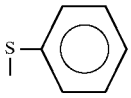 |
| (96) | 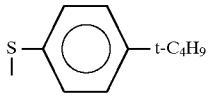 | (97) | 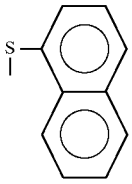 |
(98)–(105)
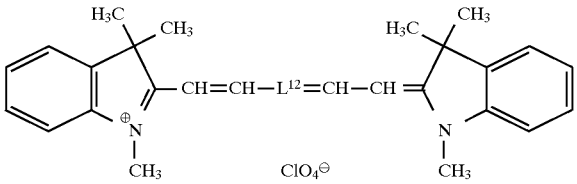
| | $L^{12}$ | | $L^{12}$ |
|---|---|---|---|
| (98) | 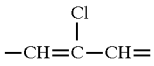 | (99) | 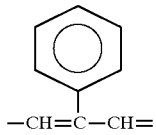 |
| (100) | 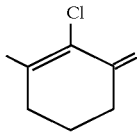 | (101) | 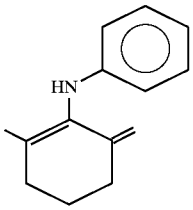 |

-continued
(102)
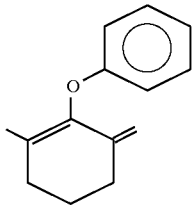
(103)
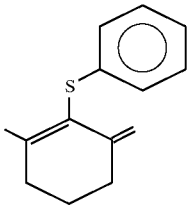
(104)
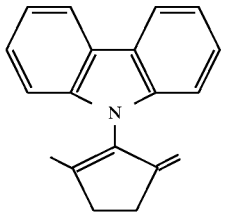
(105)
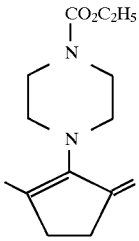
(106)–(110)
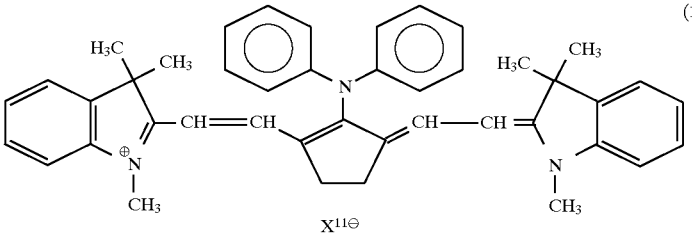
$X^{11\ominus}$
$X^{11\ominus}$
| | | | |
|---|---|---|---|
| (106) | $ClO_4^{\ominus}$ | (107) | $PF_6^{\ominus}$ |
| (108) | 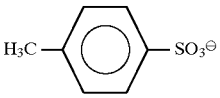 | (109) | $I^{\ominus}$ |
| (110) | $Br^{\ominus}$ | | |
(111)
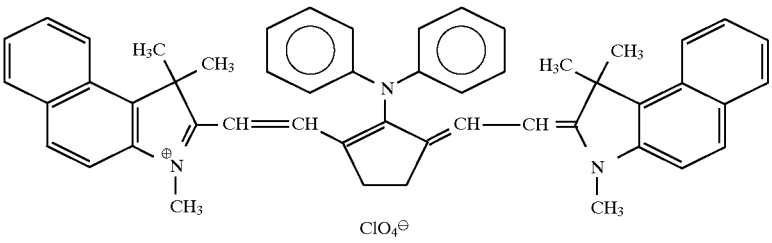
$ClO_4^{\ominus}$
(112)
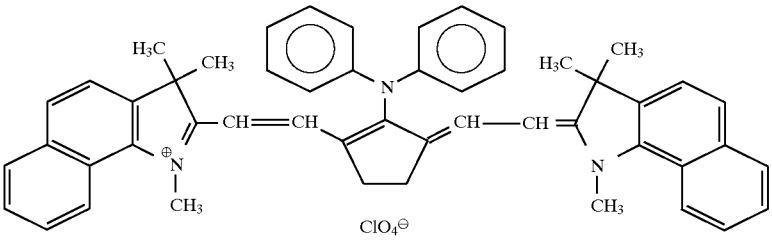
$ClO_4^{\ominus}$ -continued
(113)
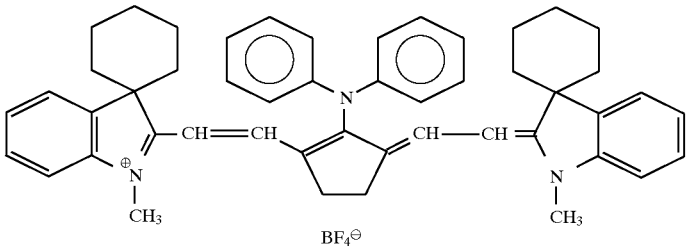
(114)–(116)
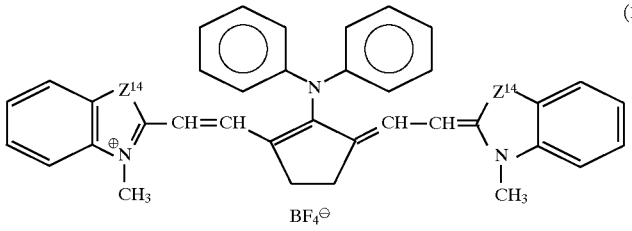
| | $Z^{14}$ | | $Z^{14}$ | | $Z^{14}$ |
|---|---|---|---|---|---|
| (114) | O | (115) | S | (116) | $N-CH_3$ |
(117)
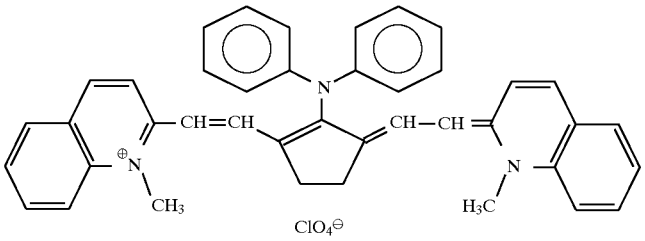
(118)
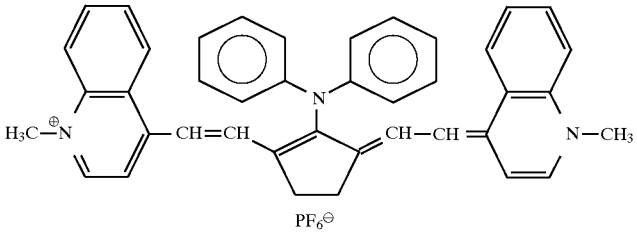
(119)–(120)
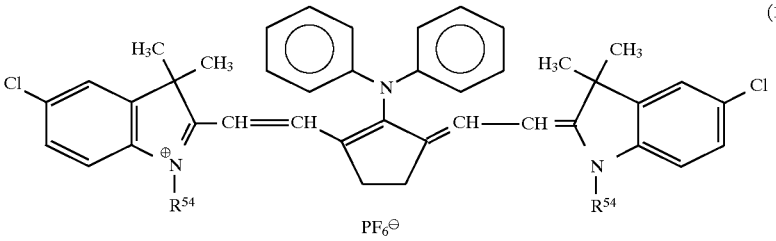
| | $R^{54}$ | | $R^{54}$ |
|---|---|---|---|
| (119) | 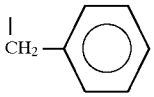 | (120) | 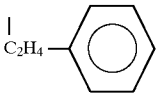 |
| (121) | 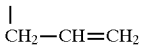 | | |

-continued
(122)
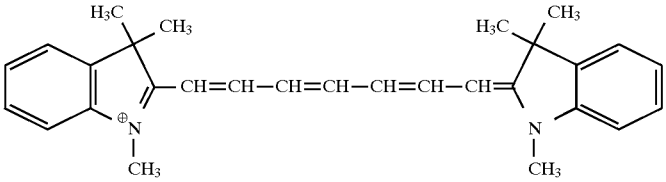
$BF_4^{\ominus}$
(123)
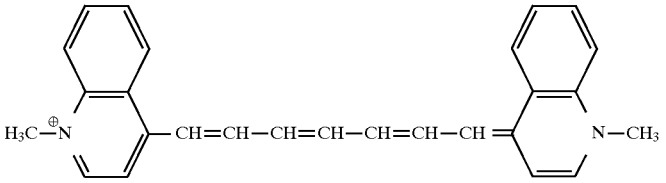
$Cl^{\ominus}$
(124)
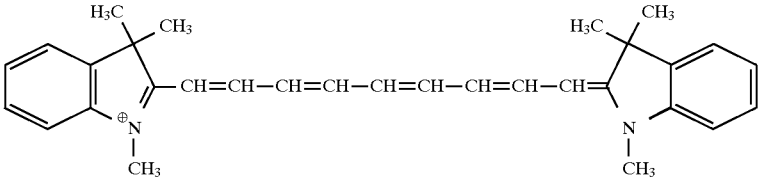
$ClO_4^{\ominus}$
(125)
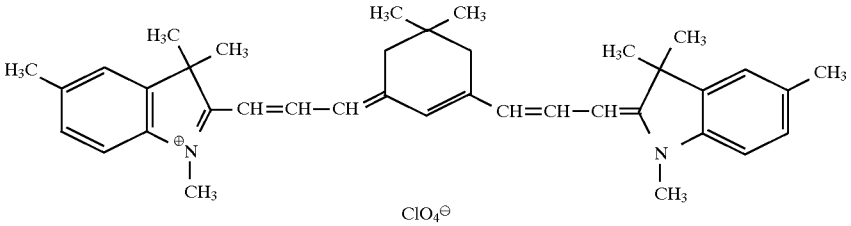
$ClO_4^{\ominus}$
(126)–(127)
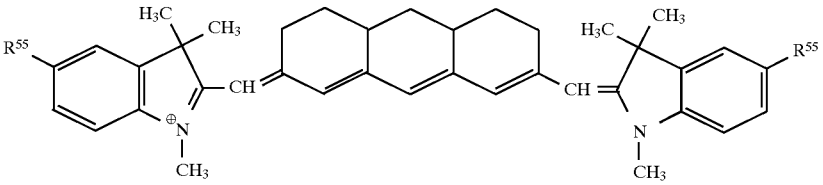
| | $R^{55}$ | | $R^{55}$ |
|---|---|---|---|
| (126) | H | (127) | $CO_2H$ |
(128)–(130)
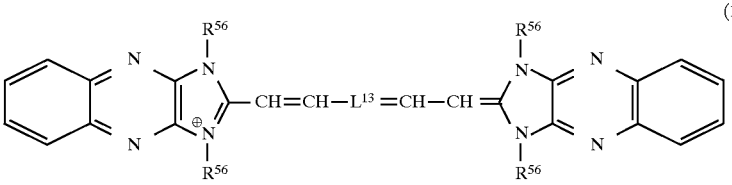
$ClO_4^{\ominus}$
| | $R^{56}$ | $L^{13}$ |
|---|---|---|
| (128) | $C_2H_4CO_2H$ | $-CH=CH-CH=$ |
| (129) | $C_2H_4CO_2H$ | 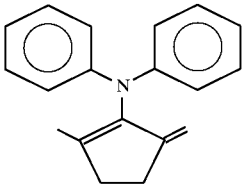 |

-continued

| | | |
|---|---|---|
| (130) | $C_3H_7$ | 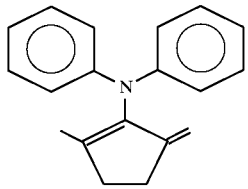 |

The cyanine dye can be synthesized according to the following synthesis examples. Further, similar synthesis methods are described in U.S. Pat. Nos. 2,095,854, 3,671,648, Japanese Patent Provisional Publications No. 61(1987)-123252 and No. 6(1994)-43583.

SYNTHESIS EXAMPLE 1

Synthesis of compound (1)

With 100 ml of ethyl alcohol, 9.8 g of 1,2,3,3-tetramethyl-5-carboxyindolenium p-toluenesulfonate, 6 g of 1-[2,5-bis (anilinomethylene) cyclopentylidene]-diphenylanilinium tetrafluoroborate, 5 ml of acetic anhydride and 10 ml of triethylamine were mixed. The mixture was stirred for 1 hour at the external temperature of 100° C. Precipitated crystals were filtered off, and were recrystallized with 100 ml of methyl alcohol to obtain 7.3 g of the compound (1).

Melting point: 270° C. or more

λ max: 809.1 nm

ϵ: $1.57\times10^5$ (dimethylsulfoxide)

SYNTHESIS EXAMPLE 2

Synthesis of compound (43)

With 10 ml of methyl alcohol, 2 g of 1,2,3,3-tetramethyl-5-carboxyindolenium p-toluenesulfonate was mixed. To the mixture, 1.8 ml of triethylamine and 0.95 g of N-phenyl[7-phenylamino-3,5-(β,β-dimethyltrimethylene)heptatriene-2,4,6-indene-1]ammonium chloride were added. To the mixture, 2 ml of acetic anhydride was further added. The resulting mixture was stirred for 3 hours at the room temperature. To the mixture, 2 ml of water was added. Precipitated crystals were filtered off to obtain 1.1 g of the compound (43).

Melting point: 270° C. or more

λ max: 855.0 nm

ϵ: $1.69\times10^5$ (methanol)

SYNTHESIS EXAMPLE 3

Synthesis of compound (63)

With 100 ml of ethyl alcohol, 11.4 g of 1,2,3,3-tetramethyl-5-chloroindolenium p-toluenesulfonate, 7.2 g of N-(2,5-dianilinomethylenecyclopentylidene)-diphenylaminium tetrafluoroborate, 6 ml of acetic anhydride and 12 ml of triethylamine were mixed. The mixture was stirred for 1 hour at the external temperature of 100° C. Precipitated crystals were filtered off, and were recrystallized with 100 ml of methyl alcohol to obtain 7.3 g of the compound (63).

Melting point: 250° C. or more

λ max: 800.8 nm

ϵ: $2.14\times10^5$ (chloroform)

The cyanine dye may be subjected to lake formation. A preferred lake cyanine dye is represented by the formula (II):

$$(D)—A_m.Y_n \quad \text{(II)}$$

In the formula (II), D is a skeleton of a cyanine dye represented by the formula (Ia):

$$R^1—\overset{\oplus}{N}=(CH—CH)_a=\overset{Z^1}{C}—L=\overset{Z^2}{C}—(CH=CH)_b—N—R^2 \quad \text{(Ia)}$$

In the formula (Ia), each of $Z^1$ and $Z^2$ independently is a non-metallic atomic group that forms a five-membered or six-membered nitrogen-containing heterocyclic ring, which may be condensed with another ring; each of $R^1$ and $R^2$ independently is an alkyl group, an alkenyl group or an aralkyl group; L is a linking group having conjugated double bonds formed by a combination of five, seven or nine methine groups; and each of a and b independently is 0 or 1.

In the formula (Ia), $Z^1$, $Z^2$, $R^1$, $R^2$, L, a and b have the same meanings as $Z^1$, $Z^2$, $R^1$, $R^2$, L, a and b in the formula (I).

In the formula (II), A is a charged anionic group that is attached to D as a substituent group. Examples of the anionic groups include carboxyl, sulfo, phenolic hydroxide, a sulfonamido group, sulfamoyl and phosphono. Carboxyl, sulfo and a sulfonamido group are preferred. Carboxyl is particularly preferred.

In the formula (II), Y is a cation, which relates to the lake formation of the cyanine dye. Examples of inorganic cations include alkaline earth metal ions (e.g., $Mg^{2+}$, $Ca^{2+}$, $Ba^{2+}$, $Sr^{2+}$), transition metal ions (e.g., $Ag^+$, $Zn^{2+}$) and other metal ions (e.g., $Al^{3+}$). Examples of organic cations include ammonium ion, amidinium ion and guanidium ion. The organic cation preferably has 4 or more carbon atoms. A divalent or trivalent cation is preferred.

In the formula (II), m is an integer of 2 to 5, and preferably is 2, 3 or 4.

In the formula (II), n is an integer of 1 to 5 that is required for a charge balance. Usually, n is 1, 2 or 3.

The lake cyanine dye may be in the form of a complex salt.

Examples of the lake cyanine dyes are shown below.

(131)–(135)
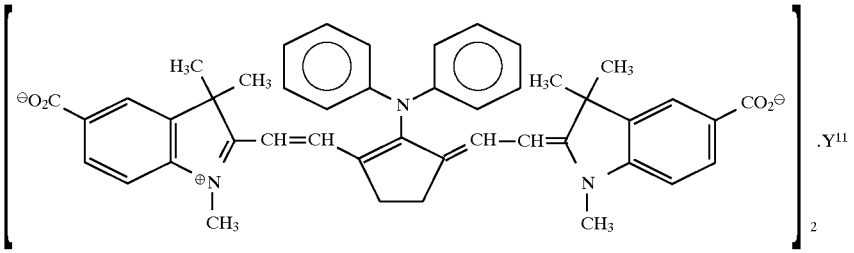
| | $Y^{11}$ | | $Y^{11}$ | | $Y^{11}$ |
|---|---|---|---|---|---|
| (131) | $Ca^{2\oplus}$ | (132) | $Ba^{2\oplus}$ | (133) | $Mg^{2\oplus}$ |
| (134) | $Sr^{2\oplus}$ | (135) | $Zn^{2\oplus}$ | | |
(136)–(140)
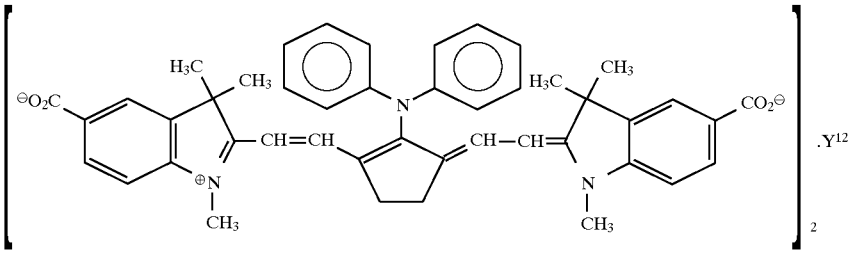
$Y^{12}$
(136)
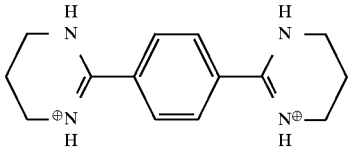
(137)
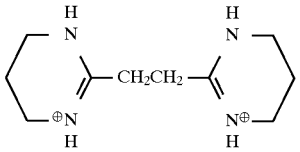
(138)
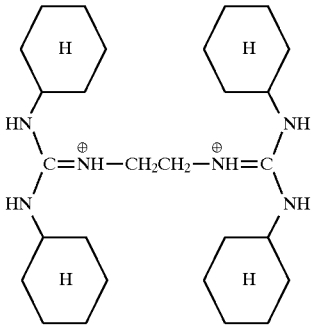
(139)
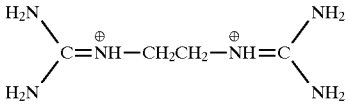
(140)
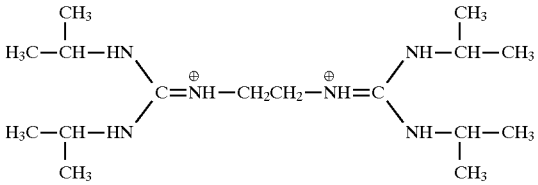

-continued
(141)
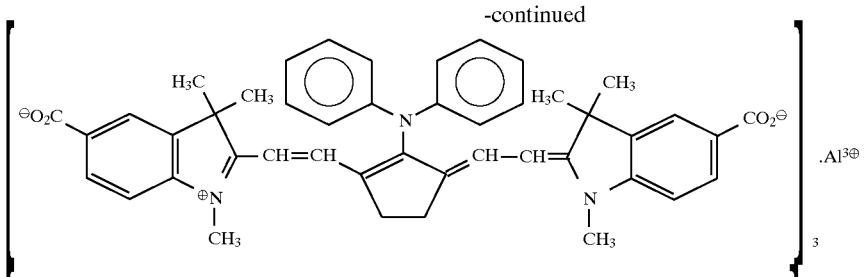
(142)
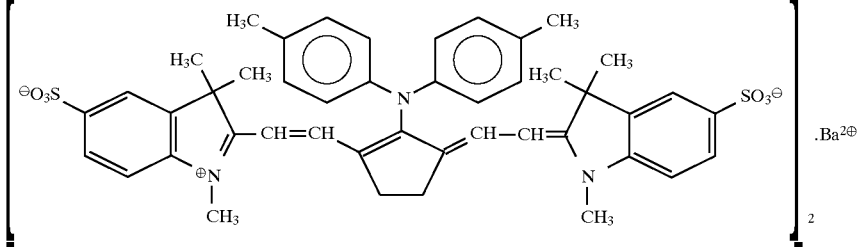
(143)
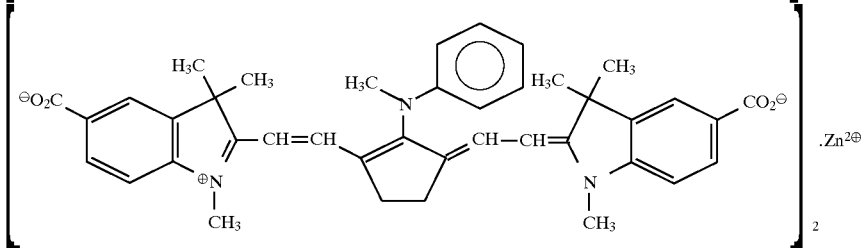
(144)
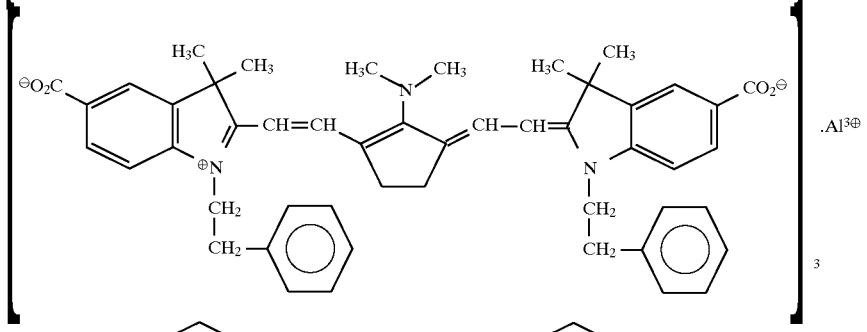
(145)
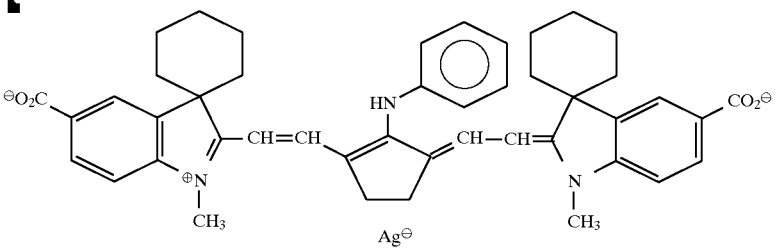
(146)
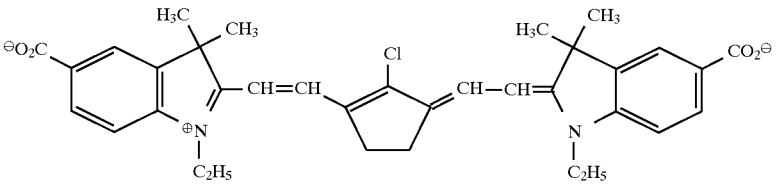
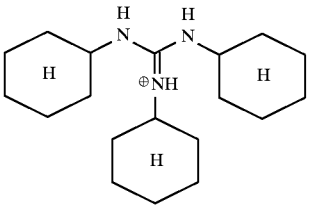

-continued
(147)
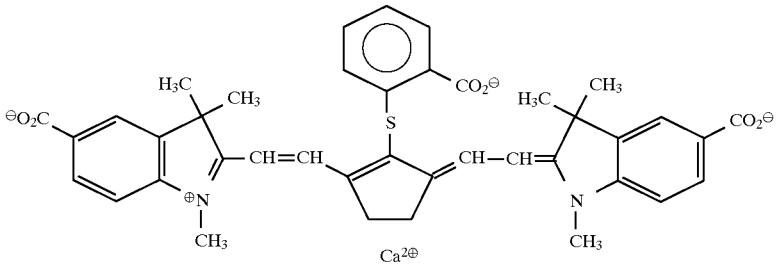
(148)
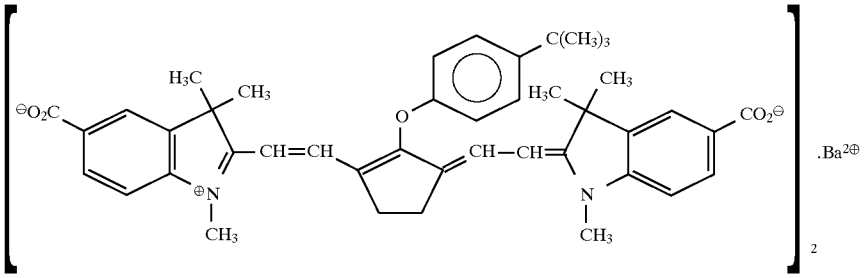
(149)
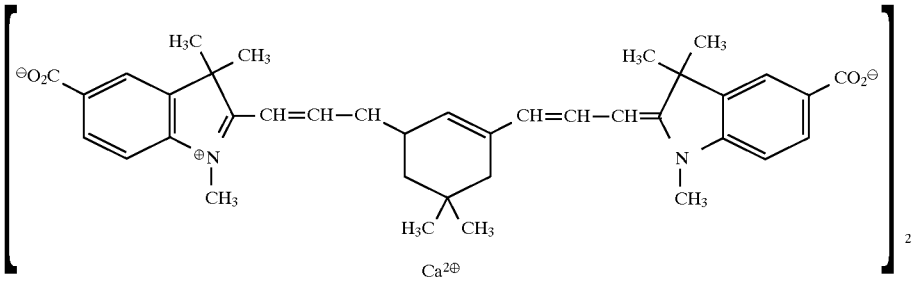
(150)
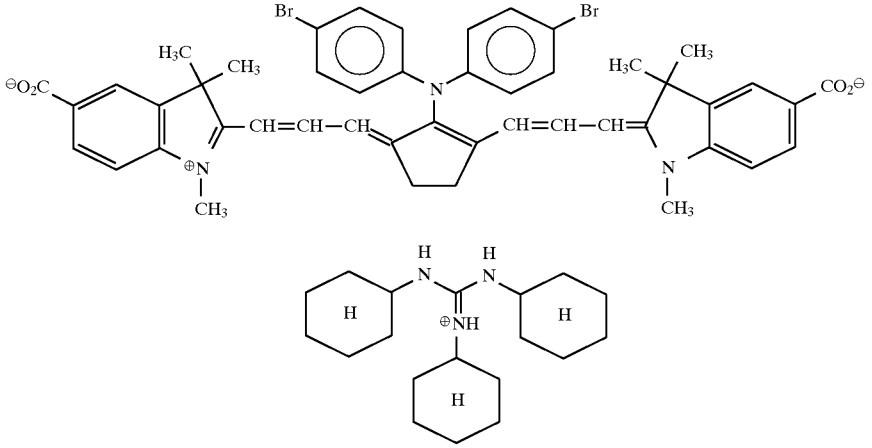
(151)
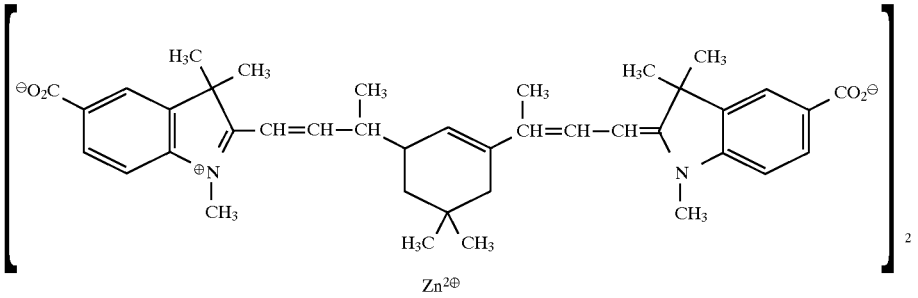

-continued
(152)
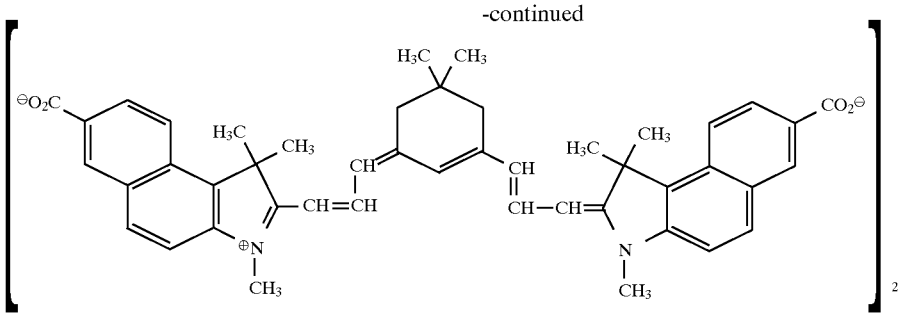
$Ba^{2\oplus}$
(153)
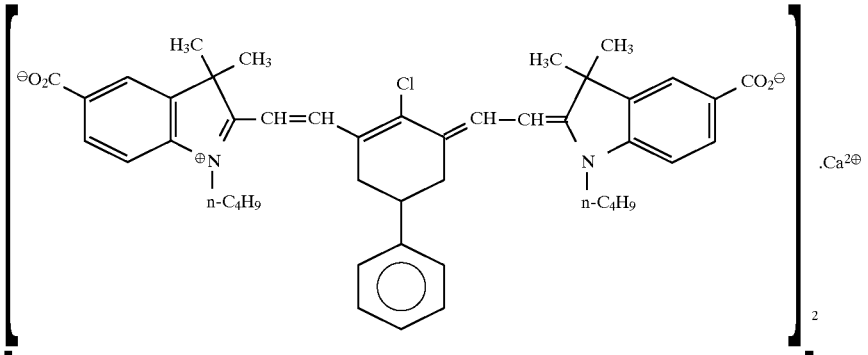
$.Ca^{2\oplus}$
(154)
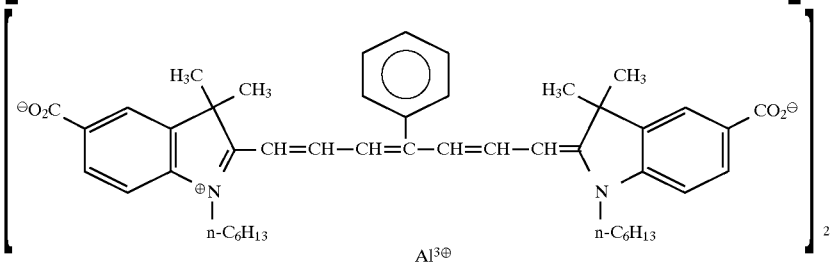
$Al^{3\oplus}$
(155)–(157)
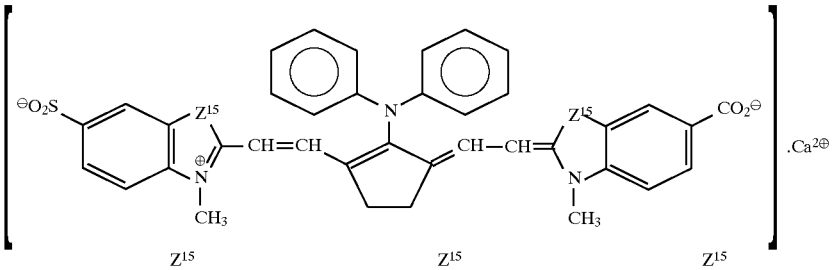
$.Ca^{2\oplus}$
| | $Z^{15}$ | | $Z^{15}$ | | $Z^{15}$ |
|---|---|---|---|---|---|
| (155) | O | (156) | S | (157) | N—$CH_3$ |
(158)
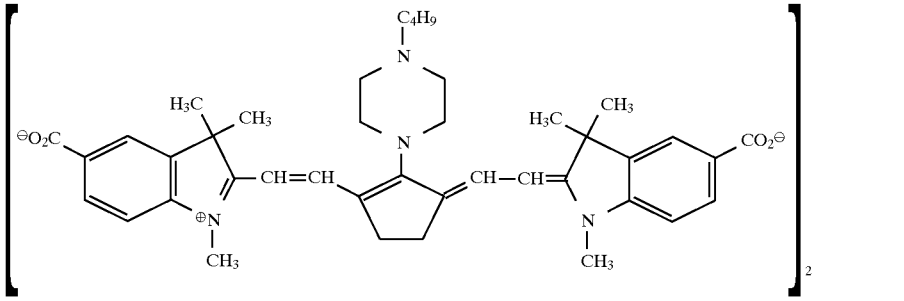
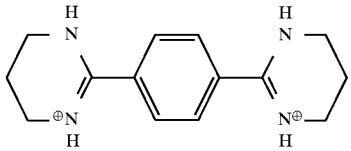

-continued
(159)
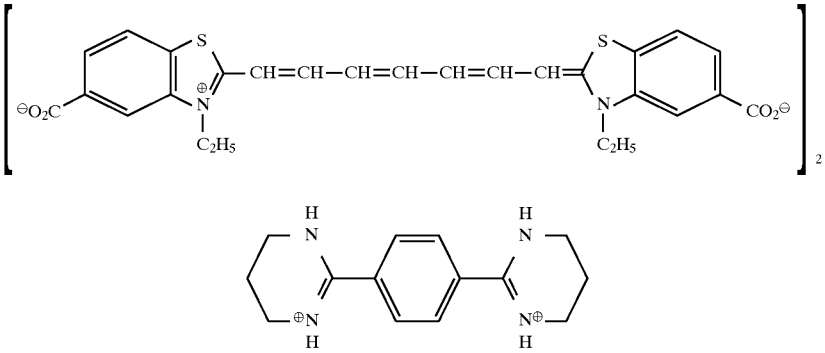
(160)
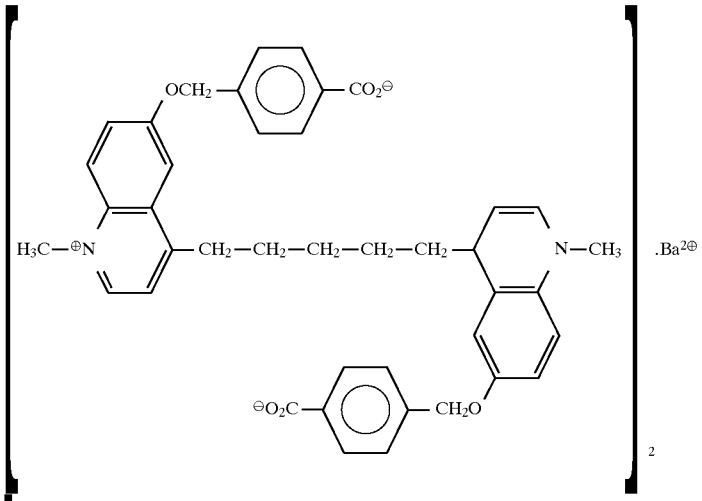
(161)
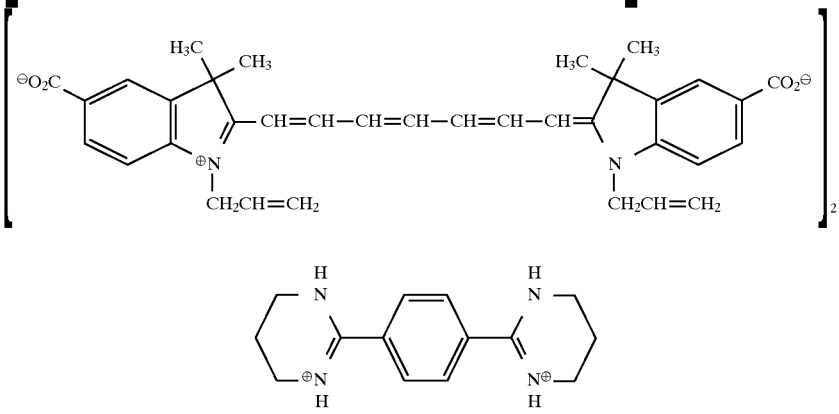
(162)
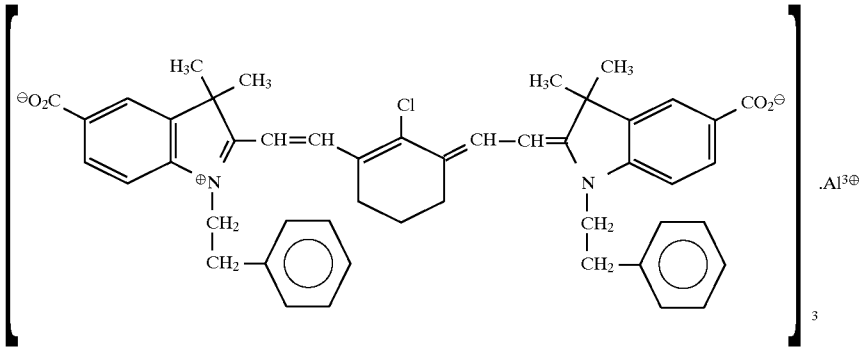

-continued
(163)
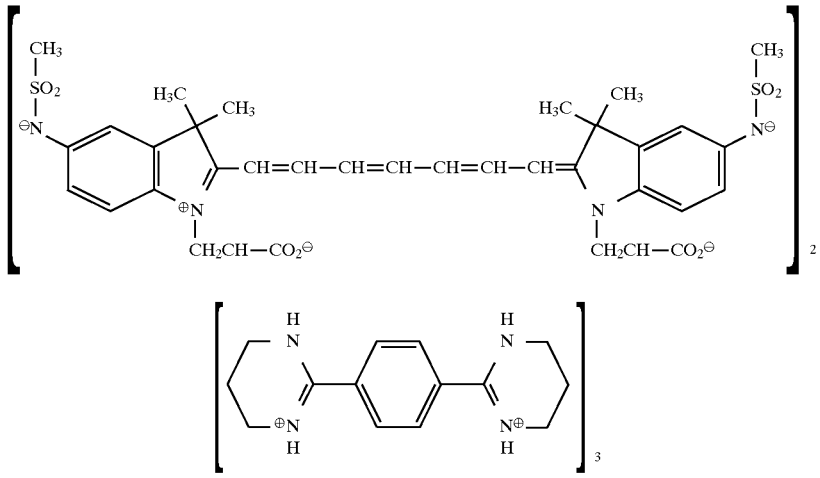
(164)
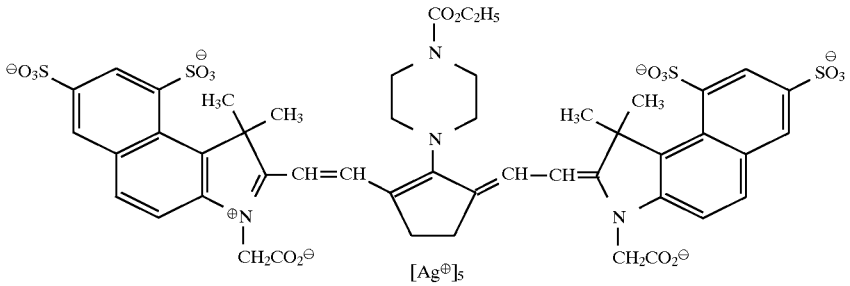
(165)
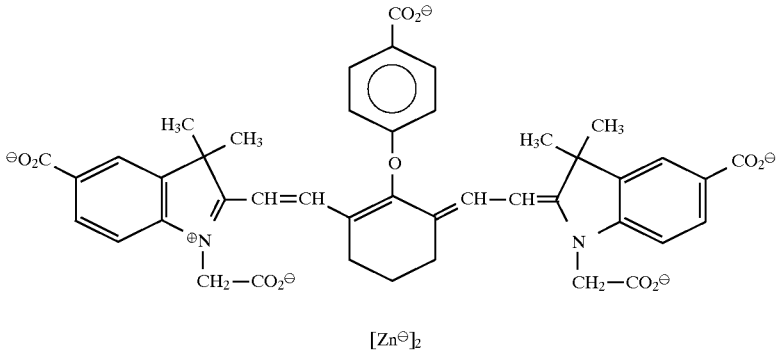

-continued (166)

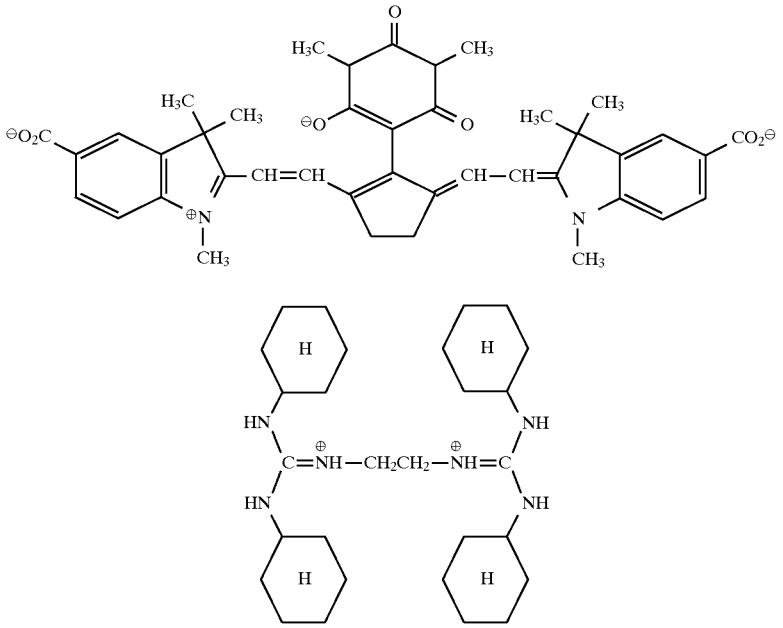

(167)

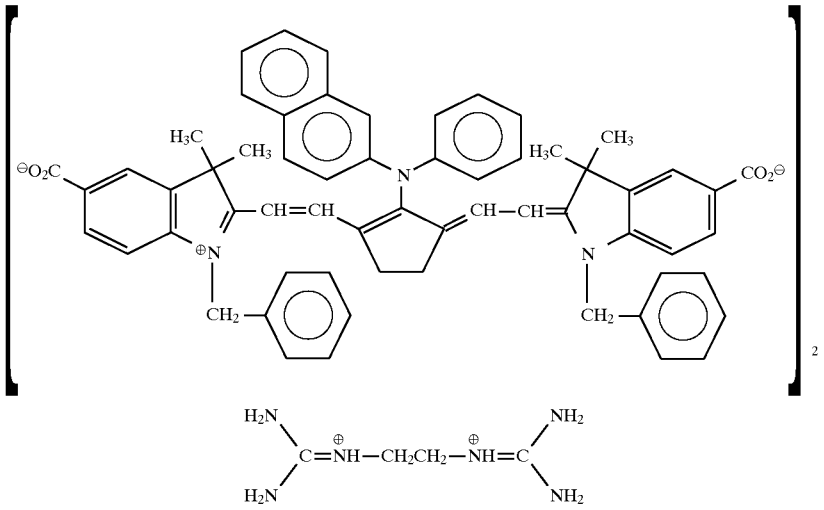

The lake cyanine dye can be synthesized according to the following synthesis examples.

SYNTHESIS EXAMPLE 4

Synthesis of compound (131)

In 50 ml of water, 4 g of crystals of the compound (1) and 2.6 ml of triethylamine were dissolved. To the solution, 20 ml of an aqueous solution of 2 g of calcium chloride was added. The mixture was stirred for 1 hour. Precipitated crystals were filtered off to obtain 11.5 g of the compound (131) in the form of wet cake. The dry weight of the compound was 3.4 g.

SYNTHESIS EXAMPLE 5

Synthesis of compound (132)

The procedures in the synthesis example 4 were repeated except that barium chloride was used in place of calcium chloride. Thus, 10.6 g of the compound (132) in the form of wet cake was obtained. The dry weight of the compound was 3.4 g.

SYNTHESIS EXAMPLE 6

Synthesis of compound (141)

The procedures in the synthesis example 4 were repeated except that $Al_{13}O_4(OH)_{24}(H_2O)_{12}Cl_7$ (Aluminumhydrocyloride-P, Hext) was used in place of calcium chloride. Thus, 12.0 g of the compound (141) in the form of wet cake was obtained. The dry weight of the compound was 1.7 g.

SYNTHESIS EXAMPLE 7

Synthesis of compound (138)

In 30 ml of methanol, 4 g of crystals of the compound (1) and 1.7 ml of triethylamine were dissolved. To the solution, 3.3 g of the following guanidine compound dissolved in 20 ml of methanol was added. The mixture was stirred for 3 hours at the room temperature. Precipitated crystals were filtered off to obtain 3.9 g of the compound (138) in the form of wet cake. The dry weight of the compound was 2.1 g.

(Guanidine compound)

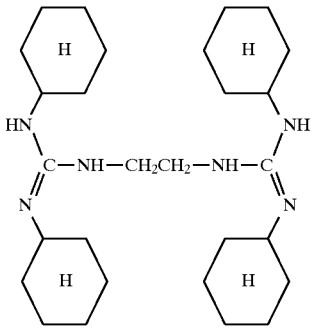

In the present invention, the infrared absorbing colorant was used in the form of solid particles. The solid particles can be prepared by using a conventional dispersing device. Examples of the conventional devices include ball mills, sand mills, colloid mills, vibration ball mills, planet ball mills, jet mills, roll mills, mantongaurins, microfluidizers and deskimpeller mills. The dispersing devices are described in Japanese Patent Provisional Publication No. 52(1977)-92716 and International Patent Publication No. 88/074794. Longitudinal or lateral dispersing devices can be used.

The solid particle dispersion can be prepared by a conventional process. The conventional process is described in Japanese Patent Provisional Publication No. 52(1977)-92716 and International Patent Publication No. 88/04794. The conventional dispersing devices can be used. Examples of the conventional devices include ball mills, sand mills, colloid mills, vibration ball mills, planet ball mills, jet mills, roll mills, mantongaurins, microfluidizers and deskimpeller mills. Longitudinal or lateral dispersing devices can be used.

The particles can be dispersed in a medium (e.g., water, alcohol). A dispersing surface active agent is preferably added to the medium. An anionic surface active agent is preferably used. Preferred anionic surface active agents are described in Japanese Patent Provisional Publication No. 52(1977)-92716 and International Patent Publication No. 88/04794. If necessary, an anionic polymer, a nonionic surface active agent or a cationic surface active agent can be used in place of the anionic surface active agent.

The particles in the form of fine powder can be formed by dissolving the infrared ray absorbing colorant in a solvent and adding a bad solvent to the solution. In this case, the above-mentioned dispersing surface active agent can also be added to the solvent. Further, the particles can be formed by dissolving the colorant in a solvent at a controlled pH and adjusting the pH to precipitate fine crystals of the colorant.

In the case that a lake dye is used, a dye corresponding to (D)–$A_m$ in the formula (II) is dissolved in a solvent, and a water soluble salt of a cation corresponding to Y in the formula (II) is added to the solution to precipitate fine crystals of the lake dye.

The infrared absorbing colorant is added to the silver halide emulsion layer or a non-light-sensitive hydrophilic colloidal layer of the silver halide photographic material. The non-light-sensitive hydrophilic colloidal layers include a backing layer, a protective layer and an undercoating layer. The backing layer is provided on the opposite side of the support. The protective layer is provided on the emulsion layers. The undercoating layer is directly provided on the support. The colorant is preferably added to the backing layer or the protective layer, and more preferably added to the protective layer.

The infrared absorbing colorant can be used with another colorant. The other colorants are described in Japanese Patent Provisional Publication No. 2(1990)-103536 at page 17.

A hydrophilic colloid is used in the emulsion layer or the hydrophilic colloidal layer. Gelatin is the most preferred hydrophilic colloid. Lime-treated gelatin, acid-treated gelatin, enzyme-treated gelatin, a gelatin derivative and denatured gelatin can be used. Lime-treated gelatin and acid-treated gelatin are preferred. The other hydrophilic colloids are described in Japanese Patent Provisional Publication No. 6(1994)-67338 at page 18.

There are no specific limitations with respect to the support, the silver halide emulsion, various additives and development methods. These are described in Japanese Patent Provisional Publication No. 6(1994)-67338 at pages 18 to 19. The silver halide should not have a sensitivity within the infrared region of 700 to 1,100 nm.

Silver bromide, silver chlorobromide and silver iodochlorobromide can be used as silver halide. Silver chlorobromide is particularly preferred. The silver chloride content in the silver chlorobromide is preferably in the range of 20 to 100 mol %.

The silver halide photographic material of the present invention can be used as a printing photographic material, a microfilm photographic material, a medical X-ray photographic material, an industrial X-ray photographic material, a general negative photographic material or a general reversal photographic material. The material can also be used as a black and white or color photographic material. The present invention is particularly effective in a medical X-ray photographic material. The medical X-ray photographic material has at least two silver halide emulsion layers. One of the emulsion layers is provided on one side of the support, and another of the emulsion layers is provided on the opposite side of the support.

The present invention is also effective in the case that the coated amount of silver is small. The coated amount is preferably in the range of 1 to 4 g per $m^2$, and more preferably in the range of 1.5 to 3.0 g per $m^2$. In the case that a photographic material (such as X-ray photographic material) has two or more silver halide emulsion layers provided on both sides of the support. The above-mentioned amount of silver means the total amount of silver contained in the emulsion layers.

The present invention is further effective in the case that the photographic material is developed in an automatic developing machine having an infrared detecting mechanism. The detecting mechanism comprises a light source and an photoelectric element. The light source emits light of 700 nm or more. Examples of the light sources include a light emitting diode and a semiconductor laser. The light emitting diode is commercially available (such as CL-515, Sharp Corporation and TLN108, Toshiba Co., Ltd.). The photoelectric element has a sensitivity within the region of 700 to 1,200 nm and the maximum sensitivity about 900 nm. The photoelectric element is commercially available (such as PT501, Sharp Corporation and TPS601A, Toshiba Co., Ltd.). Further, an automatic developing machine having the infrared detecting mechanism is also commercially available.

In the authomatic developing machine, the mechanism (in more detail, the photoelectric element) detects the inserted photographic material to send a signal to the developing machine. The signal works the developing machine to start up conveying rollers and replenishing mechanisms.

The present invention is particularly effective in a rapid development process and a process using a small amount of a replenisher. The photographic material is developed preferably for 30 to 240 seconds, and more preferably for 30 to 120 seconds. The amount of the replenisher is preferably in the range of 20 to 300 ml per $m^2$, and more preferably in the range of 50 to 130 ml per $m^2$.

There are no specific limitations with respect to the other developing conditions. The development process using an automatic developing machine is described in Japanese Patent Provisional Publications No. 3(1991)-13937 at pages 20–21, 25, 30–31, 40, 45–46 and 52–53, No. 3(1991)-171136 at pages 18–19 and No. 6(1994)-43583 at page 27.

The photographic material can also be effectively used in an exposing apparatus having the infrared detecting mechanism. The exposing apparatus having the infrared detecting mechanism is also commercially available (from Chiyoda Medical Co., Ltd., Konika Co., Ltd., Canon Inc., Toshiba Co., Ltd. and Shimazu Seisakusho, Ltd.).

REFERENCE EXAMPLE 1

Preparation of solid particle dispersion

The dyes set forth in Table 1 were treated in the state of wet cake without drying. To the dye (dry solid weight: 2.5 g), 15 g of 5% aqueous solution of carboxymethylcelluloses was added. Water was added to the mixture make the total amount 63.3 g. The mixture was well stirred to make slurry. The slurry and 100 cc of glass beads (diameter: 0.8 to 1.2 mm) were placed in a dispersing device (1/16 G sand grinder mill, Aimex Co., Ltd.). The slurry was stirred for 12 hours. Water was added to the slurry to form a solid particle dispersion having a dye concentration of 2 wt. %.

Preparation of coated samples

On a polyethylene terephthalate film having an undercoating layer, the following coating solution was coated.

| Coating solution | |
|---|---|
| Gelatin | 3 g/$m^2$ |
| Solid particle dispersion of a dye | 25 mg/$m^2$ |
| 1,2-bis(vinylsulfonylacetamido)ethane (hardening agent) | 56 mg/$m^2$ |
| Compound A | 20 mg/$m^2$ |

Compound A

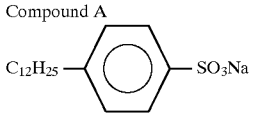

Evaluation of samples

The spectral absorption of the coated sample was measured using a spectrophotometer (U-2000, Hitachi, Ltd.) to determine the absorption maximum wavelength (λmax). Further, the absorption at 450 nm and the absorption at the maximum wavelength were measured. Then the ratio of the former absorption to the latter absorption was determined. A dye showing a high ratio has an absorption within the visible region to cause a yellow color. The results are set forth in Table 1.

Further, a solution of the dye was prepared using a solvent set forth in Table 1. The spectral absorption of the solution was measured. The results are set forth in Table 1.

TABLE 1

| Sample No. | Infrared absorbing dye | λmax of coated sample | Ratio of 450 nm to λmax | Solvent | λmax of solution |
|---|---|---|---|---|---|
| 101 | (62) | 915 nm | 0.05 | Methanol | 785 nm |
| 102 | (63) | 910 nm | 0.05 | Methanol | 801 nm |
| 103 | (1) | 922 nm | 0.04 | DMSO | 809 nm |
| 104 | (72) | 910 nm | 0.02 | Methanol | 785 nm |
| 105 | (131) | 892 nm | 0.05 | DMSO | 809 nm |
| 106 | (a) | 730 nm | 0.15 | $H_2O$ (pH 10) | 634 nm |
| 107 | (b) | 888 nm | 0.15 | $H_2O$ (pH 10) | 775 nm |
| 108 | (c) | 900 nm | 0.18 | Methanol/$CHCl_3$ | 816 nm |
| 109 | (d) | 1,100 nm | 0.30 | Methanol | 920 nm |

(Remark)

DMSO: Dimethylsulfoxide

Dye (a)

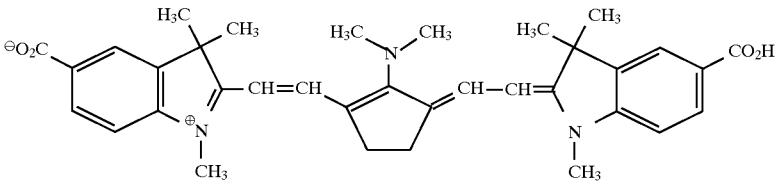

(disclosed in Japanese Patent Provisional Publication No. 3(1991)-138640)

Dye (b)

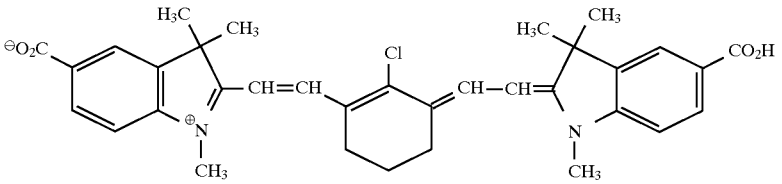

(disclosed in Japanese Patent Provisional Publication No. 3(1991)-138640)

TABLE 1-continued

| Sample No. | Infrared absorbing dye | λmax of coated sample | Ratio of 450 nm to λmax | Solvent | λmax of solution |
|---|---|---|---|---|---|

Dye (c)

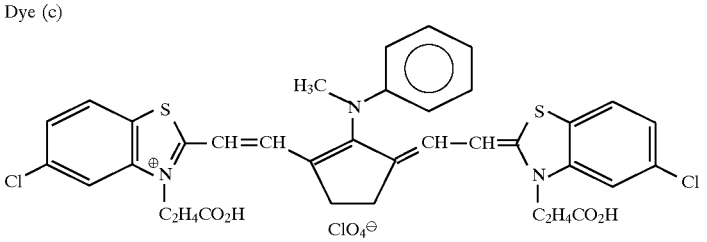

(disclosed in Japanese Patent Provisional Publication No. 1(1989)-266536)

Dye (d)

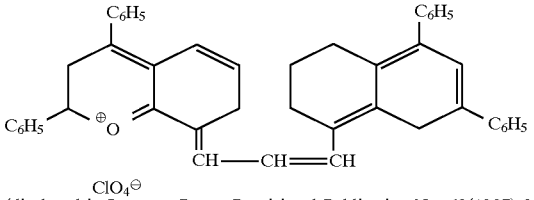

(disclosed in Japanese Patent Provisional Publication No. 62(1987)-299959)

REFERENCE EXAMPLE 2

Preparation of coated samples

Samples were prepared in the same manner as in the Reference Example 1, except that the dyes set forth in Table 2 were used.

Evaluation of samples

The spectral absorption of the coated sample was measured using a spectrophotometer (U-2000, Hitachi, Ltd.) to determine the absorption maximum wavelength (λmax).

Further, the samples were treated in an automatic developing machine (FPM-9000, Fuji Photo Film Co., Ltd.). After the treatment, the absorption of the sample was measured to determine the remaining ratio of the absorption at the maximum wavelength.

Furthermore, the samples was immersed in a BR (Briton-Robinson) buffer for 45 seconds at 35° C. and at pH 10.0. The absorption of the sample was measured again to determine the remaining ratio of the absorption at the maximum wavelength.

The results are set forth in Table 2.

TABLE 2

| | | | | Remaining ratio | |
|---|---|---|---|---|---|
| Sample No. | Infrared absorbing dye | Amount of dye | λmax | FPM-9000 | BR buffer |
| 201 | (1) | 25 mg/m$^2$ | 922 nm | 95% | 97% |
| 202 | (3) | 25 mg/m$^2$ | 911 nm | 93% | 94% |
| 203 | (9) | 25 mg/m$^2$ | 947 nm | 96% | 97% |
| 204 | (20) | 25 mg/m$^2$ | 913 nm | 97% | 99% |
| 205 | (26) | 25 mg/m$^2$ | 900 nm | 95% | 96% |
| 206 | (e) | 25 mg/m$^2$ | 870 nm | 10% | 15% |
| 207 | (b) | 25 mg/m$^2$ | 888 nm | 40% | 76% |
| 208 | (a) | 25 mg/m$^2$ | 730 nm | 83% | 93% |
| 209 | (f) | 25 mg/m$^2$ | 820 nm | 45% | 80% |

Dye (e)

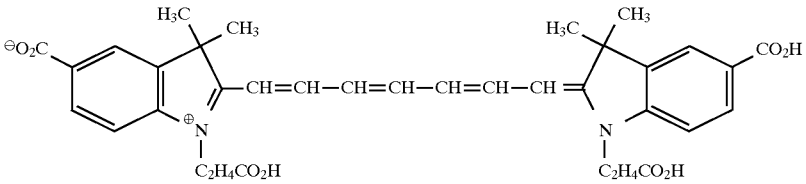

(disclosed in Japanese Patent Provisional Publication No. 3 (1991)-138640)

TABLE 2-continued

| Sample No. | Infrared absorbing dye | Amount of dye | λmax | Remaining ratio FPM-9000 | Remaining ratio BR buffer |
|---|---|---|---|---|---|

Dye (f)

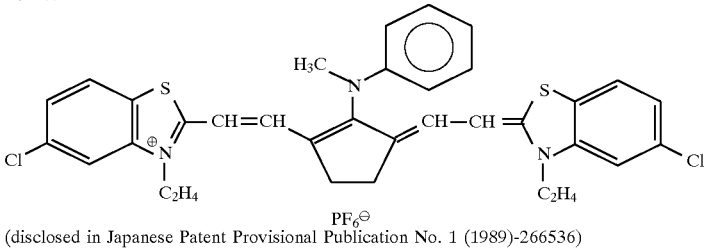

(disclosed in Japanese Patent Provisional Publication No. 1 (1989)-266536)

EXAMPLE 1

Preparation of coating solution of emulsion layer

In 820 cc of water, 3 g of sodium chloride, gelatin (average molecular weight: 20,000) and 0.04 g of 4-aminopyrazolo[3,4-d]pyrimidine were dissolved. To the solution at 55° C., an aqueous solution containing 10.0 g of silver nitrate and an aqueous solution containing 5.61 g of potassium bromide and 0.72 g of potassium chloride were added for 30 seconds while stirring according to a double jet method. An aqueous solution containing 20 g of oxidized gelatin (gelatin treated with alkali and hydrogen peroxide) and 6 g of potassium chloride was added to the mixture. The mixture was left for 25 minutes. To the mixture, an aqueous solution containing 155 g of silver nitrate and an aqueous solution containing 87.3 g of potassium bromide and 21.9 g of potassium chloride were added for 58 minutes according to a double jet method. The feeding rate was accelerated so that the final feeding rate was three times the initial feeding rate.

Further, an aqueous solution containing 5 g of silver nitrate and an aqueous solution containing 2.7 g of potassium bromide, 0.6 g of sodium chloride and 0.013 g of $K_4Fe(CN)_6$ were added to the mixture for 3 minutes according to a double jet method. The mixture was cooled to 35° C. Soluble salts were removed according to a sedimentation method. The mixture was heated to 40° C. To the mixture, 28 g of gelatin, 0.4 g of zinc nitrate and 0.051 g of benzoisothiazolone were added. The mixture was adjusted to pH 6.0 using sodium hydroxide. At least 80% of the obtained silver halide grains have an aspect ratio of 3 or more. The average diameter (based on the projected area) was 0.85 μm. The average thickness was 0.151 μm. The silver chloride content was 20 mol %.

The emulsion was heated to 56° C. To the emulsion, 0.002 mol (based on the amount of silver) of silver iodide fine grains (average grain size: 0.05 μm) was added while stirring. To the emulsion, 4.8 mg of sodium ethylthiosulfinate, 520 mg of the following sensitizing dye and 112 mg of 4-hydroxy-6-methyl-1,3,3a,7-tetrazaindene were added. Further, 1.8 mg of chloroauric acid, 100 mg of potassium thiocyanate, 1.8 mg of sodium thiosulfate pentahydrate and 2.15 mg of the following selenium compound were added to the emulsion. The emulsion was subjected to a chemical sensitization, and cooled immediately.

(Sensitizing dye)

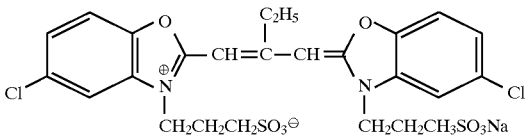

(Selenium compound)

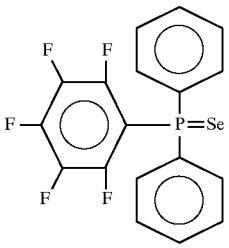

To the obtained emulsion, the following additives were added based on 1 mol of silver halide to prepare a coating solution.

| Additives for coating solution | |
|---|---|
| 2,6-Bis(hydroxyamino)-4-diethylamino-1,3,5-triazine | 80 mg |
| Sodium polyacrylate (average molecular weight: 41,000) | 4.0 g |
| Compound B | 9.7 g |
| Ethyl acrylate/acrylic acid/methacrylic acid copolymer plasticizer (95/2/3) | 20.0 g |
| Nitron | 50 mg |
| Compound C | 5.0 mg |
| Gelatin | (total coating amount) 1.2 g/m$^2$ |

Compound B

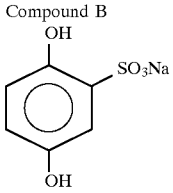

-continued

| Additives for coating solution |
|---|

Compound C

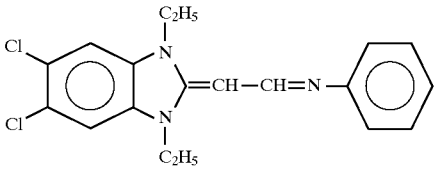

Preparation of photographic material

A polyethylene terephthalate film having undercoating layers on both sides was used as a support. On both sides of the support, the following coating solutions were coated to prepare photographic materials.

| Silver halide emulsion layers | |
|---|---|
| Coated silver amount | 1.25 g/m$^2$ |
| Surface protective layers | |
| Gelatin | 0.61 g/m$^2$ |
| Dextran (average molecular weight: 39,000) | 0.61 g/m$^2$ |
| Sodium polyacrylate (average molecular weight: 41,000) | 70 mg/m$^2$ |
| 1,2-Bis(sulfonylacetamido)ethane (hardening agent) | 56 mg/m$^2$ |
| Methyl methacrylate/methacrylic acid copolymer particles (9/1, matting agent, average particle size: 3.5 $\mu$m) | 0.06 g/m$^2$ |
| 4-Hydroxy-6-methyl-1,3,3a,7-tetrazaindene | 15.5 mg/m$^2$ |
| Coating aid I | 13 mg/m$^2$ |
| Coating aid II | 45 mg/m$^2$ |
| Coating aid III | 6.5 mg/m$^2$ |
| Coating aid IV | 3 mg/m$^2$ |
| Coating aid V | 1 mg/m$^2$ |
| Coating aid VI | 1.7 mg/m$^2$ |
| Coating aid VII | 100 mg/m$^2$ |

Coating aid I

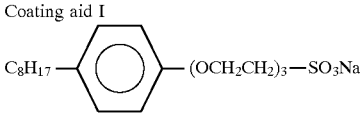

Coating aid II $C_{16}H_{33}O-(CH_2CH_2O)_{10}-H$

Coating aid III $C_{17}H_{33}CON(CH_3)CH_2CH_2SO_3Na$

Coating aid IV $C_8F_{17}SO_2N(C_3H_7)-(CH_2CH_2O)_{16}-H$

Coating aid V $C_8F_{17}SO_2N(C_3H_7)-(CH_2CH_2O)_4-(CH_2)_4-SO_3Na$

Coating aid VI

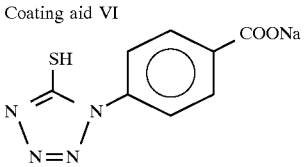

-continued

Coating aid VII

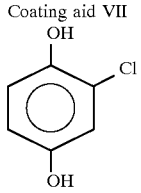

Further, solid particle dispersions of the dyes set forth in Table 3 were added to the emulsion layers or the surface protective layers. The dispersions were prepared in the same manner as in the Reference Example 1. The coated amount of the dye was 25 mg/m$^2$.

Evaluation of photographic materials

The spectral absorption of the sample was measured using a spectrophotometer (U-2000, Hitachi, Ltd.) to determine the absorption maximum wavelength ($\lambda$max).

Further, the samples were treated in an automatic developing machine (modified FPM-9000, Fuji Photo Film Co., Ltd.). Into the machine, ten sheets of the photographic material were inserted, and the number of the detected sheet was counted. The developing machine has an infrared ray emitting element (GL-514, Sharp Corporation) and a photoelectric element (PT501, Sharp Corporation) at its inlet for the photographic material. When the infrared ray is shielded with an inserted sample sheet, the conveying rollers work to convey the sample sheet to a development bath.

The results are set forth in Table 3.

TABLE 3

| Sample No. | Infrared absorbing dye | Added layer | $\lambda$max | Number of detected sheets |
|---|---|---|---|---|
| 301 | (1) | Protective | 922 nm | 10 |
| 302 | (3) | Protective | 911 nm | 10 |
| 303 | (9) | Protective | 947 nm | 10 |
| 304 | (20) | Protective | 913 nm | 10 |
| 305 | (26) | Protective | 900 nm | 10 |
| 306 | (1) | Emulsion | 922 nm | 10 |
| 307 | (3) | Emulsion | 911 nm | 10 |
| 308 | (e) | Protective | 870 nm | 5 |
| 309 | (b) | Protective | 888 nm | 8 |
| 310 | (a) | Protective | 730 nm | 2 |
| 311 | (f) | Protective | 820 nm | 4 |
| 312 | (e) | Emulsion | 870 nm | 5 |
| 313 | (f) | Emulsion | 820 nm | 4 |
| 314 | None | — | — | 0 |

After the treatment, the absorption of the sample was measured to determine the remaining ratio of the absorption at the maximum wavelength.

Further, the sample was immersed in a BR (Briton-Robinson) buffer for 45 seconds at 35° C. and at pH 10.0. The absorption of the sample was measured again to determine the remaining ratio of the absorption at the maximum wavelength.

Furthermore, the sample was exposed to X-ray through water-phantom of 10 cm using a screen (HR-4, Fuji Photo Film Co., Ltd.), while the sample was sandwiched with two screens. The sample was then developed in the automatic developing machine to obtain an image. The sensitivity of the sample was measured. The relative sensitivity was determined based on the fogging value (including base density) plus 1.0. The sensitivity is the relative value where the sensitivity of the sample 301 is 100. The results are set forth in Table 4.

TABLE 4

| Sample No. | Infrared absorbing dye | Remaining ratio in FPM-9000 | Remaining ratio in BR buffer | Relative sensitivity |
|---|---|---|---|---|
| 301 | (1) | 95% | 97% | 100 |
| 302 | (3) | 93% | 94% | 102 |
| 303 | (9) | 96% | 97% | 100 |
| 304 | (20) | 97% | 99% | 98 |
| 305 | (26) | 95% | 96% | 99 |
| 306 | (1) | 95% | 97% | 99 |
| 307 | (3) | 93% | 94% | 101 |
| 308 | (e) | 10% | 15% | 76 |
| 309 | (b) | 40% | 76% | 72 |
| 310 | (a) | 83% | 93% | 51 |
| 311 | (f) | 45% | 80% | 48 |
| 312 | (e) | 10% | 15% | 63 |
| 313 | (f) | 45% | 80% | 45 |
| 314 | None | — | — | 110 |

(Remark)
In the samples Nos. 306, 307, 312 and 313, the dye was added to the emulsion layers. In the other samples, the dye was added to the protective layers.

The automatic developing machine (modified FPM-9000, Fuji Photo Film Co., Ltd.) is described below. The machine can process about 200 sheets of 10×12 inch size on one day.

The processing steps are described below.

| Processing | Tank | Temp. | Length | Time |
|---|---|---|---|---|
| Development | 22 l | 35° C. | 613 mm | 8.8 seconds |
| Fixing | 15.5 l | 32° C. | 539 mm | 7.7 seconds |
| Washing | 15 l | 17° C. | 263 mm | 3.8 seconds |
| Squeezing | | | 304 mm | 4.4 seconds |
| Drying | | 58° C. | 368 mm | 5.3 seconds |
| Total | | | 2087 mm | 30.0 seconds |

(Remark)
Length: the length of processing pass

In the tank for development, the surface area of the liquid per the volume of the tank is 25 $cm^2$ per liter. The washing step is conducted by using flowing water. The drying step is conducted by heated air from a pair of heated rollers at 100° C.

The processing solutions are shown below.

| Part A of developing solution | |
|---|---|
| Potassium hydroxide | 270 g |
| Potassium sulfite | 1,125 g |
| Sodium carbonate | 450 g |
| Boric acid | 75 g |
| Diethylene glycol | 150 g |
| Diethylene triaminetetracetic acid | 30 g |
| 1-(N,N-diethylamino)-5-mercaptotetrazole | 1.5 g |
| Hydroquinone | 405 g |
| 4-Hydroxymethyl-4-methyl-1-phenyl-3-pyrazolidone | 30 g |
| Water (make up to) | 4,500 ml |
| **Part B of developing solution** | |
| Triethylene glycol | 750 g |
| 3,3'-Dithiobishydrocinnamic acid | 3 g |
| Glacial acetic acid | 75 g |
| 5-Nitroindazole | 4. 5 g |
| 1-Phenyl-3-pyrazolidone | 67.5 g |
| Water (make up to) | 1,000 ml |

-continued

| Part C of developing solution | |
|---|---|
| Glutaraldehyde (50 wt. %/vol. %) | 150 g |
| Potassium bromide | 15 g |
| Potassium metabisulfite | 120 g |
| Water (make up to) | 750 ml |
| **Fixing solution (condensed)** | |
| Ammonium thiosulfate (70 wt. %/vol. %) | 3,000 ml |
| Disodium ethylenediaminetetraacetic acid dihydrate | 0.45 g |
| Sodium sulfite | 225 g |
| Boric acid | 60 g |
| 1-(N,N-dimethylamino)ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |
| Aluminum sulfate | 150 g |
| Water (make up to) | 6,000 ml |
| pH | 4.68 |

Each of the parts A, B and C is separately placed in containers, which are connected to each other. The fixing solution is also placed in a similar container.

First, 300 ml of an aqueous solution of 54 g of acetic acid and 55.5 g of potassium bromide is placed in a developing tank as a starter.

Next, the containers are inserted into inlets of stock tanks attached to the side of the developing machine. The inlets have a blade, which cuts the sealing membrane of the cap of the container. Thus, the processing solutions are poured into the stock tanks.

The processing solutions are then conveyed to the developing tank and the fixing tank by a pomp attached to the developing machine.

In the case that 8 sheets of 10×12 inch size are processed, the tanks were supplied according to the following mixing ratio.

| Final developing solution | |
|---|---|
| Part A | 60 ml |
| Part B | 13.4 ml |
| Part C | 10 ml |
| Water | 116.6 ml |
| pH | 10.50 |
| **Final fixing solution** | |
| Condensed solution | 80 ml |
| Water | 12.0 ml |
| pH | 4.62 |

EXAMPLE 2

Procedures in Example 1 were repeated, except that the dyes set forth in Table 5 were used. The dyes are added to the protective layers. The amount of the dye was 40 $mg/m^2$. The samples were evaluated in the same manner as in Example 1.

Further, the samples were stored for 3 days at the relative humidity of 70% and at 50° C. The change of the light absorption (absorption after storage per absorption before storage) was measured as the stability. The results are set forth in Table 5.

TABLE 5

| Sample No. | Dye | Detected sheets | Ratio (1) | Ratio (2) | Sensitivity | Stability |
|---|---|---|---|---|---|---|
| 401 | (43) | 10 | 91% | 93% | 100 | 94% |
| 402 | (44) | 10 | 94% | 96% | 102 | 95% |
| 403 | (48) | 10 | 96% | 97% | 105 | 96% |
| 404 | (56) | 10 | 96% | 98% | 103 | 98% |
| 405 | (g) | 7 | 0% | 0% | 95 | 93 |
| 406 | (h) | 7 | 87% | 89% | 98 | 90% |
| 407 | (i) | 10 | 95% | 96% | 85 | 86% |
| 408 | (j) | 10 | 94% | 95% | 100 | 84% |

(Remark)
Ratio (1): Remaining ratio FPM-9000
Ratio (2): Remaining ratio in BR buffer Dye (g)

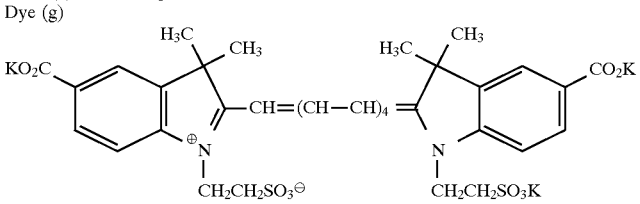

Dye (h)

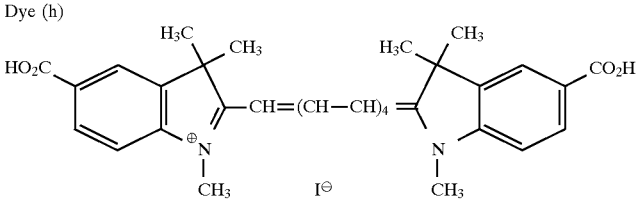

Dye (i)

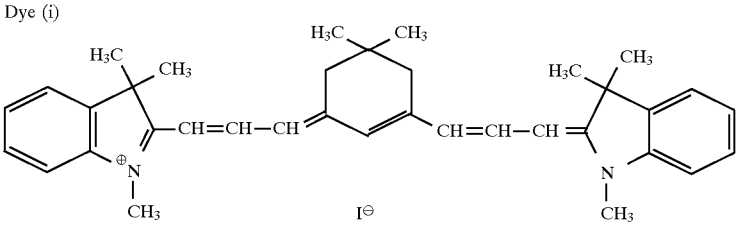

Dye (j)

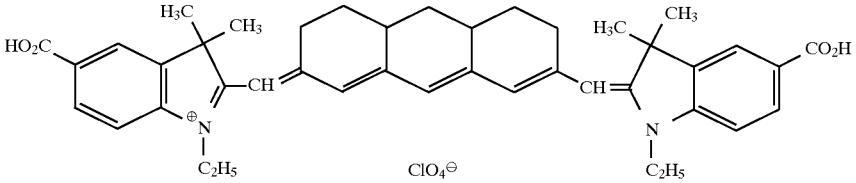

EXAMPLE 3

Procedures in Example 1 were repeated, except that the following intermediate layers containing the dyes set forth in Table 6 were provided between the emulsion layers and the surface protective layers. The samples were evaluated in the same manner as in Example 1.

| Intermediate layer | |
|---|---|
| Gelatin | 0.55 g/m$^2$ |
| Solid particle dispersion of dye | 30 mg/m$^2$ |
| Sodium polyacrylate | 10 mg/m$^2$ |
| Compound D | 2 mg/m$^2$ |
| Compound E | 0.3 mg/m$^2$ |
| Compound F | 4 mg/m$^2$ |

-continued

| Intermediate layer |
|---|
| Compound D |

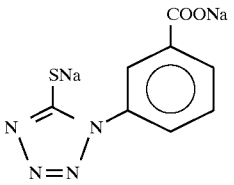

-continued

| Intermediate layer |
|---|
| Compound E 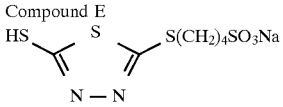 |
| Compound F 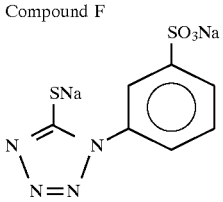 |

Further, the samples were stored for 3 days at the relative humidity of 70% and at 40° C. The number of the detected sheets in the developing machine was counted again. The results are set forth in Table 6.

TABLE 6

| Sample No. | Dye | Sheets (1) | Ratio (1) | Ratio (2) | Sensitivity | Sheets (2) |
|---|---|---|---|---|---|---|
| 501 | (62) | 10 | 100% | 100% | 100 | 10 |
| 502 | (63) | 10 | 100% | 100% | 100 | 10 |
| 503 | (64) | 10 | 96% | 97% | 100 | 10 |
| 504 | (72) | 10 | 100% | 100% | 100 | 10 |
| 505 | (74) | 10 | 95% | 97% | 100 | 10 |
| 506 | (87) | 10 | 98% | 100% | 100 | 10 |
| 507 | (a) | 3 | 84% | 94% | 50 | 2 |
| 508 | (b) | 8 | 40% | 77% | 65 | 7 |
| 509 | (c) | 75 | 45% | 80% | 48 | 4 |
| 510 | (k) | 10 | 95% | 97% | 99 | 8 |
| 511 | None | 0 | — | — | 110 | 0 |

(Remark)
Sheets (1): Number of the detected sheets before storage
Sheets (2): Number of the detected sheets after storage
Ratio (1): Remaining ratio in FPM-9000
Ratio (2): Remaining ratio in BR buffer
Dye (k)

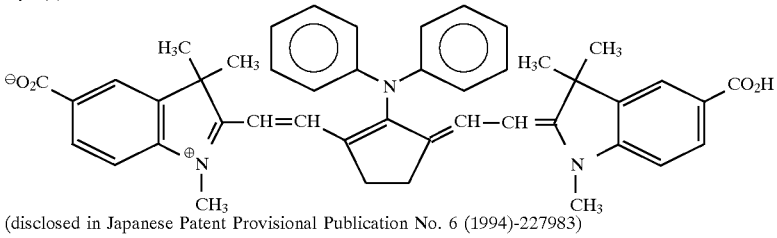

(disclosed in Japanese Patent Provisional Publication No. 6 (1994)-227983)

EXAMPLE 5

Procedures in Example 3 were repeated, except that the dyes set forth in Table 7 were used. The samples were evaluated in the same manner as in Example 1.

The results are set forth in Table 7.

| Sample No. | Dye | Detected sheets | Ratio (1) | Ratio (2) | Sensitivity |
|---|---|---|---|---|---|
| 601 | (131) | 10 | 97 | 98 | 100 |
| 602 | (132) | 10 | 99 | 100 | 100 |
| 603 | (140) | 10 | 100 | 100 | 100 |
| 604 | (149) | 10 | 100 | 100 | 100 |
| 605 | (160) | 10 | 99 | 100 | 100 |
| 606 | (141) | 10 | 99 | 100 | 100 |

(Remark)
Ratio (1): Remaining ratio in FPM-9000
Ratio (2): Remaining ratio in BR buffer

We claim:

1. A silver halide photographic material comprising a support, at least one silver halide emulsion layer and at least one non-light-sensitive hydrophilic colloidal layer, said silver halide emulsion layer or said hydrophilic colloidal layer containing a colorant having an absorption maximum wavelength within the infrared region of 700 to 1,100 nm, said colorant being in the form of solid particles dispersed in the silver halide emulsion layer or in the hydrophilic colloidal layer, and said colorant being substantially irremovable in a processing solution of the silver halide photographic material.

2. The silver halide photographic material as claimed in claim 1, wherein the solid particles have an average particle size in the range of 0.005 to 10 $\mu$m.

3. The silver halide photographic material as claimed in claim 1, wherein the colorant is contained in the silver halide emulsion layer or the hydrophilic colloidal layer in an amount of 0.001 to 1 g per $m^2$.

4. The silver halide photographic material as claimed in claim 1, wherein the colorant is a cyanine dye represented by the formula (I):

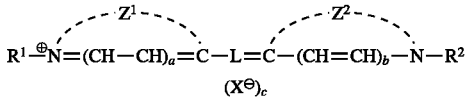

(I)

wherein each of $Z^1$ and $Z^2$ independently is a non-metallic atomic group that forms a five-membered or six-membered nitrogen-containing heterocyclic ring, which may be condensed with another ring; each of $R^1$ and $R^2$ independently is an alkyl group, an alkenyl group or an aralkyl group; L is a linking group having conjugated double bonds formed by a combination of five, seven or nine methine groups; each of a, b and c independently is 0 or 1; and X is an anion.

5. The silver halide photographic material as claimed in claim 1, wherein the colorant is a cyanine dye represented by the formula (Ib):

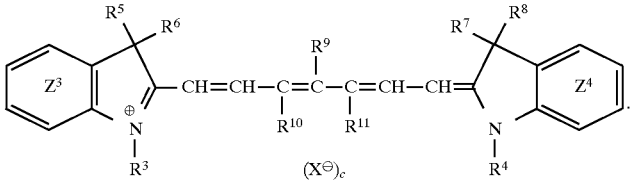

(Ib)

wherein each of the benzene rings of $Z^3$ and $Z^4$ may be condensed with another benzene ring; each of $R^3$ and $R^4$ independently is an alkyl group, an alkenyl group or an aralkyl group; each of $R^5$, $R^6$, $R^7$ and $R^8$ independently is an alkyl group, or $R^5$ and $R^6$ or $R^7$ and $R^8$ are combined with each other to form a ring; $R^9$ is hydrogen, an alkyl group, a halogen atom, an aryl group, $-NR^{14}R^{15}$ (wherein $R^{14}$ is an alkyl group or an aryl group, $R^{15}$ is hydrogen, an alkyl group, an aryl group, an alkylsulfonyl group, an arylsulfonyl group or an acyl group, or $R^{14}$ and $R^{15}$ are combined with each other to form a nitrogen-containing heterocyclic ring), an alkylthio group, an arylthio group, an alkoxy group or an aryloxy group; each of $R^{10}$ and $R^{11}$ is hydrogen, or $R^{10}$ and $R^{11}$ are combined with each other to form a five-membered or six-membered ring; X is an anion; and c is 0 or 1.

6. The silver halide photographic material as claimed in claim 1, wherein the colorant is a lake cyanine dye represented by the formula (II):

$$(D)—A_m.Y_n \quad (II)$$

wherein D is a skeleton of a cyanine dye represented by the formula (Ia); A is a charged anionic group that is attached to D as a substituent group; Y is a cation; m is an integer of 2 to 5; and n is an integer of 1 to 5 that is required for a charge balance:

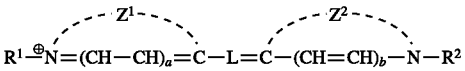

(Ia)

wherein each of $Z^1$ and $Z^2$ independently is a non-metallic atomic group that forms a five-membered or six-membered nitrogen-containing heterocyclic ring, which may be condensed with another ring; each of $R^1$ and $R^2$ independently is an alkyl group, an alkenyl group or an aralkyl group; L is a linking group having conjugated double bonds formed by a combination of five, seven or nine methine groups; and each of a and b independently is 0 or 1.

7. The silver halide photographic material as claimed in claim 1, wherein the colorant is contained in a non-light-sensitive hydrophilic colloidal layer that functions as a protective layer.

8. The silver halide photographic material as claimed in claim 1, wherein the photographic material is an X-ray photographic material that has at least two silver halide emulsion layers, one of said emulsion layers being provided on one side of the support, and another of said emulsion layers being provided on the opposite side of the support.

9. The silver halide photographic material as claimed in claim 1, wherein the photographic material contains silver halide in an amount of 1 to 4 g per $m^2$ in terms of silver.

* * * * *